US011708682B2

(12) United States Patent
Yoshida et al.

(10) Patent No.: US 11,708,682 B2
(45) Date of Patent: Jul. 25, 2023

(54) CONSTRUCTION MACHINE

(71) Applicant: HITACHI CONSTRUCTION MACHINERY CO., LTD., Tokyo (JP)

(72) Inventors: Shinichirou Yoshida, Mito (JP); Shiho Izumi, Hitachinaka (JP); Kouichi Shibata, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 707 days.

(21) Appl. No.: 16/490,238

(22) PCT Filed: Apr. 26, 2018

(86) PCT No.: PCT/JP2018/017084
§ 371 (c)(1),
(2) Date: Aug. 30, 2019

(87) PCT Pub. No.: WO2019/058622
PCT Pub. Date: Mar. 28, 2019

(65) Prior Publication Data

US 2020/0002914 A1 Jan. 2, 2020

(30) Foreign Application Priority Data

Sep. 21, 2017 (JP) ..... 2017-181793

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 3/38* (2013.01); *E02F 9/2004* (2013.01);
(Continued)

(58) Field of Classification Search
CPC ..... E02F 3/435; E02F 3/32; E02F 3/38; E02F 9/2004; E02F 9/2271; E02F 9/264; E02F 9/265
See application file for complete search history.

(56) References Cited

U.S. PATENT DOCUMENTS 6,615,114 B1 9/2003 Skiba et al.
8,909,437 B2 12/2014 Zhu et al.
(Continued)

FOREIGN PATENT DOCUMENTS

CN 102482866 A 5/2012
CN 104011302 A 8/2014
(Continued)

OTHER PUBLICATIONS

International Preliminary Report on Patentability received in corresponding International Application No. PCT/JP2018/017084 dated Apr. 2, 2020.
(Continued)

*Primary Examiner* — James M Mcpherson
*Assistant Examiner* — Kyle J Kingsland
(74) *Attorney, Agent, or Firm* — Mattingly & Malur, PC

(57) ABSTRACT

A hydraulic excavator includes a computer-aided construction controller for performing machine control to operate a front work implement based on detected results from posture sensors and predetermined conditions. The computer-aided construction controller has a calibration posture storing section that stores at least one predetermined calibration posture of the front work implement for calibrating the posture sensors, and a calibration posture controlling section that carries out the machine control to inactivate the hydraulic actuators if detection target values of the posture sensors in the calibration posture and the detected results from the posture sensors are equal to each other. The time required for
(Continued)

calibration can thus be shortened by increasing the operability for adjusting a calibration posture.

3 Claims, 24 Drawing Sheets

(51) Int. Cl.
*E02F 3/38* (2006.01)
*E02F 9/20* (2006.01)
*E02F 9/22* (2006.01)
*E02F 9/26* (2006.01)

(52) U.S. Cl.
CPC ..... *E02F 9/2271* (2013.01); *E02F 9/264* (2013.01); *E02F 9/265* (2013.01)

(56) References Cited

U.S. PATENT DOCUMENTS

2008/0188983 A1 8/2008 Ban et al.
2012/0158234 A1 6/2012 Choi
2014/0326039 A1 11/2014 Ikegami et al.
2014/0330490 A1 11/2014 Aoki et al.
2016/0097658 A1 4/2016 Friend et al.

FOREIGN PATENT DOCUMENTS

JP 2005-121437 5/2005
JP 2008-188705 A 8/2008
JP 2017-015486 A 1/2014
JP 5635706 B1 12/2014

OTHER PUBLICATIONS

Extended European Search Report received in corresponding European Application No. 18858860.2 dated Jul. 6, 2021.
Chinese Office Action received in corresponding Chinese Application No. 201880013627.7 dated Sep. 14, 2021.
Chinese Office Action received in corresponding Chinese Application No. 201880013627.7 dated Jan. 19, 2021.
Korean Office Action received in corresponding Korean Application No. 10-2019-7024500 dated Oct. 12, 2020.
International Search Report of PCT/JP2018/017084 dated Jul. 31, 2018.

CONSTRUCTION MACHINE

TECHNICAL FIELD

The present invention relates to a construction machine.

BACKGROUND ART

According to a computer-aided construction technology, a hydraulic excavator, for example, which is one of construction machines, has a function (referred to as "machine control") for automatically or semiautomatically controlling, with a computer (controller), the actuators for actuating a boom, an arm, and a bucket that make up a work implement (hereinafter also referred to as "front work implement"). The machine control is applied to an excavating work where when the hydraulic excavator excavates a ground site (when the arm or the bucket is operated), the actuators are controlled to move the tip end of the bucket along a target surface (hereinafter also referred to as "target excavation surface").

Such computer-aided construction machines are required to be calibrated for maintaining desired construction accuracy levels. Patent Document 1, for example, discloses, as a technology about the calibration of construction machines, an apparatus for assisting in the initial calibration of the strokes of hydraulic cylinders. The calibration assisting apparatus includes movable members that are angularly movably supported successively on a machine body, hydraulic cylinders disposed between the machine body and the movable members or between the movable members and supporting the movable members angularly movably thereon, stroke sensors disposed on the hydraulic cylinders for measuring the stroke lengths of the hydraulic cylinders, a reset sensor for measuring reset reference points at which to reset the measured values of the stroke lengths from the stroke sensors, a stroke end detection processor for detecting stroke end positions of the hydraulic cylinders, a calibration processor for calibrating the measured values of the stroke lengths when the reset reference points and/or the stroke end positions are detected, a monitor for displaying an overall work machine on which the hydraulic cylinders are installed when the hydraulic cylinders are initially calibrated, and a highlight display processor for displaying highlighted movable members for actuating hydraulic cylinders to be calibrated and also displaying directions in which to actuate the hydraulic cylinders.

PRIOR ART DOCUMENT

Patent Document

Patent Document 1: JP-5635706-A

SUMMARY OF THE INVENTION

Problem to be Solved by the Invention

According to the above prior art, the operator operates the boom, the arm, and the bucket while viewing the display on the monitor thereby to perform an adjusting process for causing the front work implement to take a prescribed posture. However, for achieving a prescribed posture for calibration (hereinafter also referred to as "calibration posture"), it is necessary to make strict adjustments with respect to the angles of the various components of the front work implement. Since the operator achieves a prescribed posture by repeatedly operating the actuators, it takes time to adjust the front work implement to the prescribed posture, contributing to an increase in the number of man hours.

The present invention has been made in view of the above problems. It is an object of the present invention to provide a construction machine that is capable of shortening the time required for calibration by increasing the operability for adjusting a calibration posture.

Means for Solving the Problem

The present application includes a plurality of means solving the problem. According to an example, there is provided a construction machine including a multi-joint front work implement that is made up of a plurality of driven members that are joined together, a plurality of hydraulic actuators that actuate the corresponding plurality of driven members, each based on an operation signal, an operation device that outputs the operation signal to one of the hydraulic actuators, the one hydraulic actuator being desired by an operator, among the plurality of hydraulic actuators, a plurality of posture sensors that detect posture information about postures of the plurality of the driven members, and a controller that carries out machine control for operating the front work implement, based on detected results from the posture sensors and predetermined conditions, in which the controller includes a calibration posture storing section that stores at least one predetermined calibration posture of the front work implement for calibrating the posture sensors, and a calibration posture controlling section that carries out the machine control to inactivate the hydraulic actuators if detection target values of the posture sensors in the calibration posture and the detected results from the posture sensors are equal to each other.

Advantage of the Invention

According to the present invention, the time required for calibration can be shortened by improving the operability for adjusting a calibration posture.

MODES FOR CARRYING OUT THE INVENTION

An embodiment of the present invention will be described hereinbelow. According to the present embodiment, a hydraulic excavator having a bucket mounted as a working tool (an attachment) on the distal end of a front implement (a front work implement) will be described as an illustrative example of construction machine. However, the present invention is applicable to a hydraulic excavator having an attachment other than the bucket, e.g., a breaker, a magnet, or the like. The present invention is also applicable to a construction machine other than a hydraulic excavator insofar as the construction machine has a multi-joint work implement made up of a plurality of driven members (a boom, an arm, an attachment, etc.) that are joined and calibrated.

Figure 1:
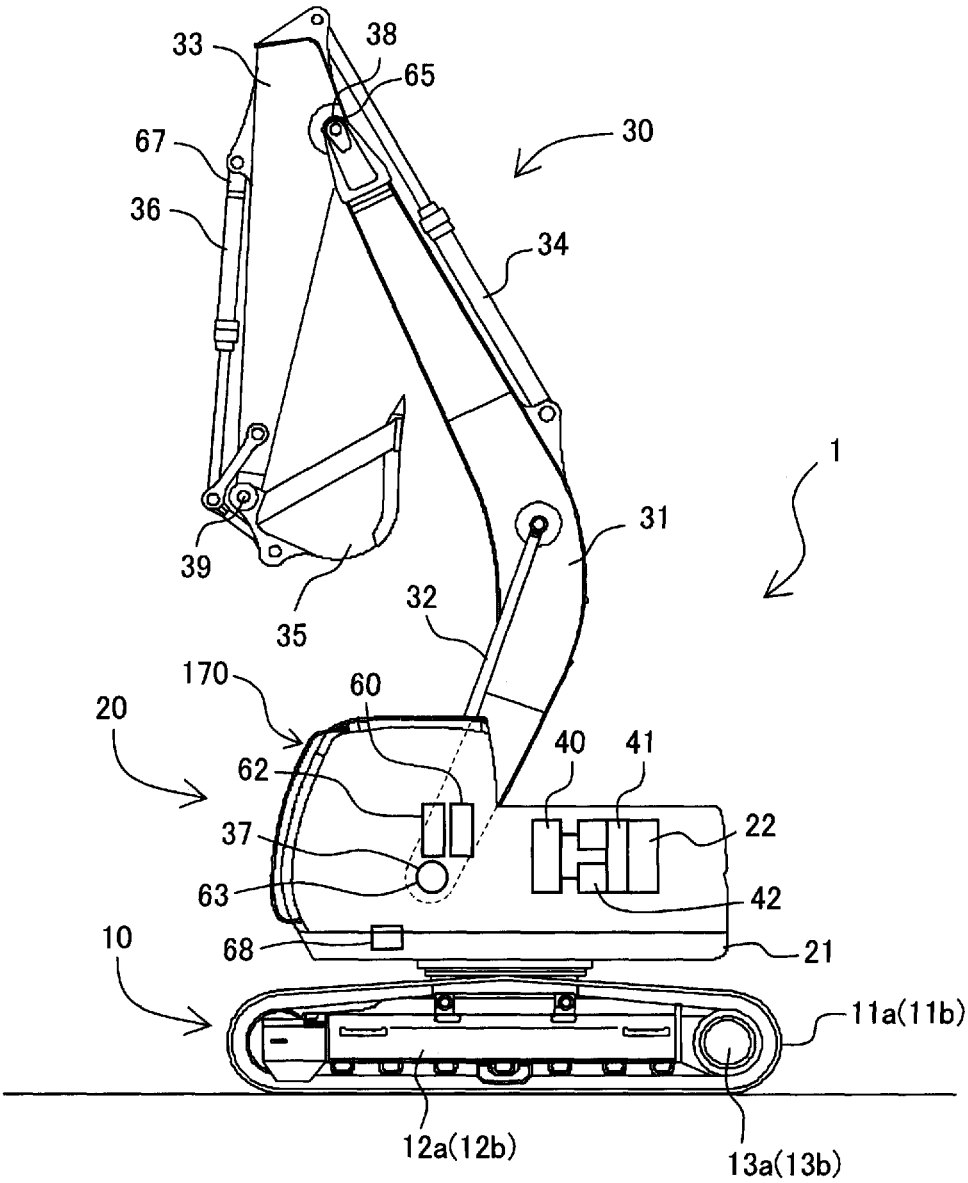
FIG. 1 is a side elevational view schematically illustrating the makeup of a hydraulic excavator as an example of construction machine.
Figure 2:
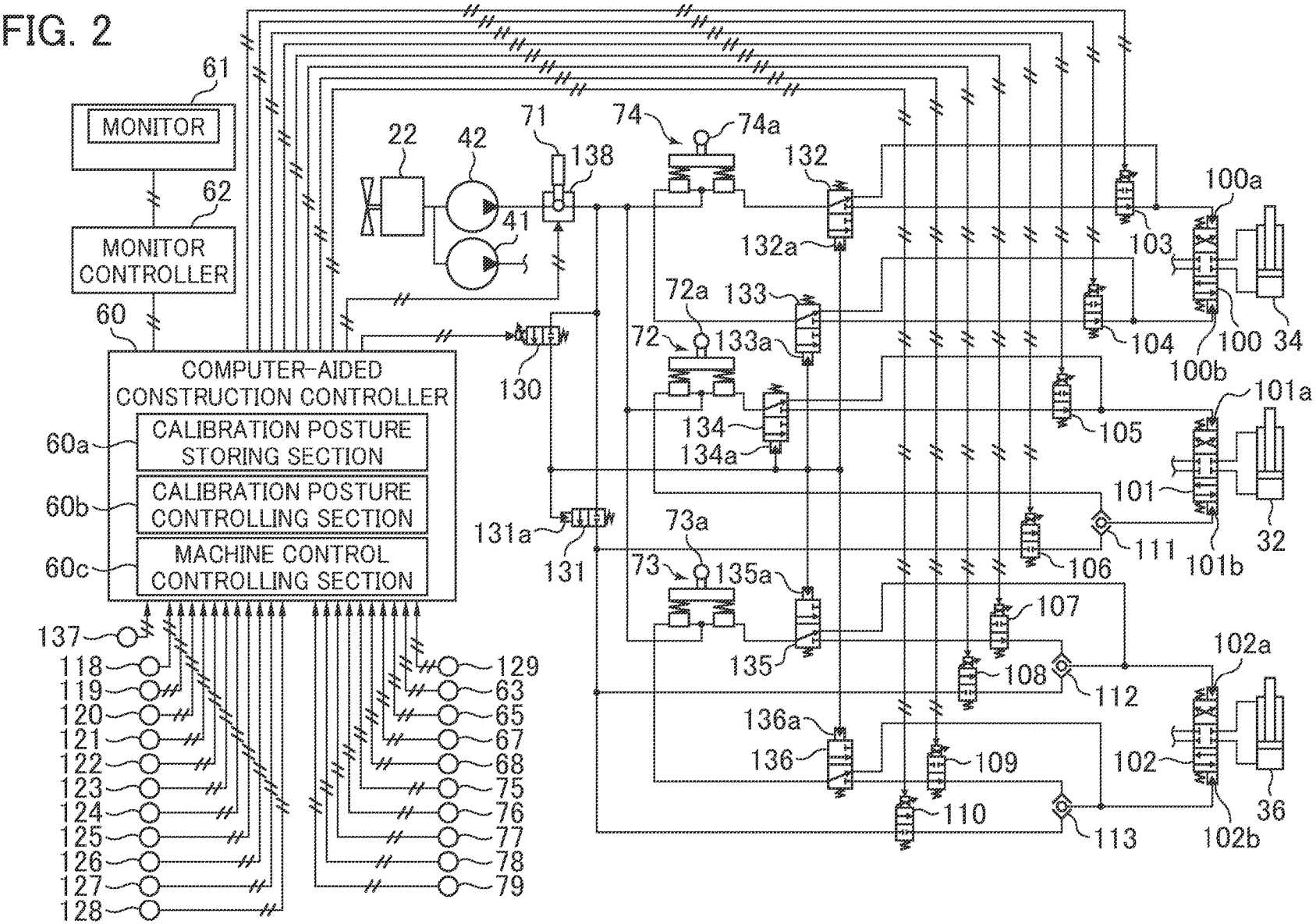
FIG. 2 is a diagram schematically illustrating a computer-aided construction controller of the hydraulic excavator together with a hydraulic pressure circuit system.
Figure 3:
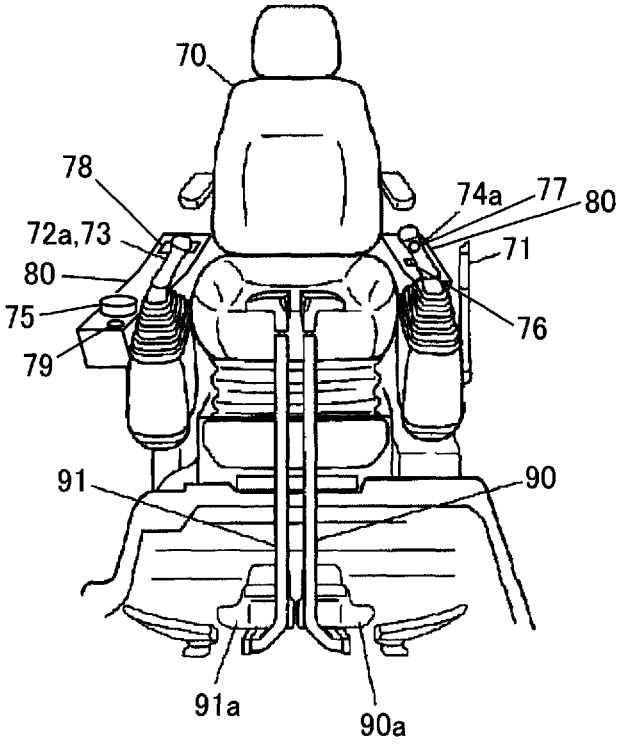
FIG. 3 is a view illustrating the appearance of an operation seat on which the operator is to be seated.
Figure 4:
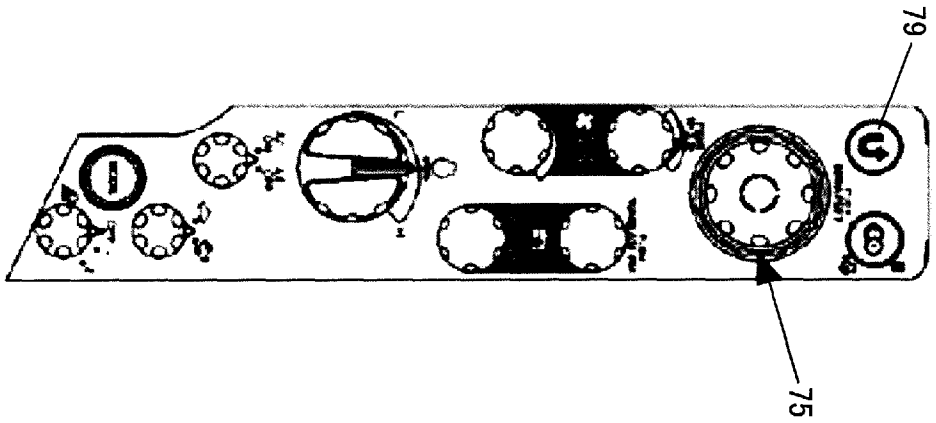
FIG. 4 is a view illustrating an extracted portion of an example of switch panel on the operation seat.

FIG. 1 is a side elevational view schematically illustrating the makeup of a hydraulic excavator as an example of construction machine. FIG. 2 is a diagram schematically illustrating a computer-aided construction controller of the hydraulic excavator together with a hydraulic pressure circuit system. FIG. 3 is a view illustrating the appearance of an operation seat on which the operator is to be seated. FIG. 4 is a view illustrating an extracted portion of an example of switch panel on the operation seat.

In FIG. 1, a hydraulic excavator 1 includes a multi-joint front work implement 30, an upper swing structure 20 that supports the front work implement 30 thereon, and a lower track structure 10 on which the upper swing structure 20 is swingably supported. The upper swing structure 20 and the lower track structure 10 make up a machine body of the hydraulic excavator 1.

The front work implement 30 is made up of a plurality of driven members (a boom 31, an arm 33, and a bucket 35) that are joined together. The boom 31 has a proximal end angularly movably supported on a front portion of the upper swing structure 20 by a boom pin 37. The arm 33 has an end angularly movable joined to a distal end of the boom 31 by an arm pin 38. The bucket 35 is angularly movably joined to the other end (a distal end), of the arm 33 by a bucket pin 39. The boom 31 is actuated by a boom cylinder 32. The arm 33 is actuated by an arm cylinder 34. The bucket 35 is actuated by a bucket cylinder 36.

Figure 5:
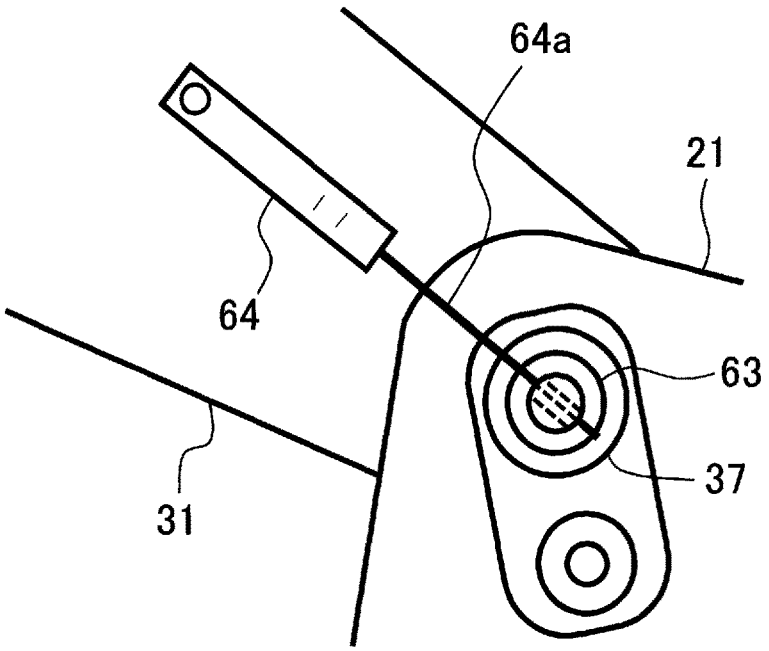
FIG. 5 is a view illustrating at an enlarged scale a joint of a boom to an upper swing structure.
Figure 6:
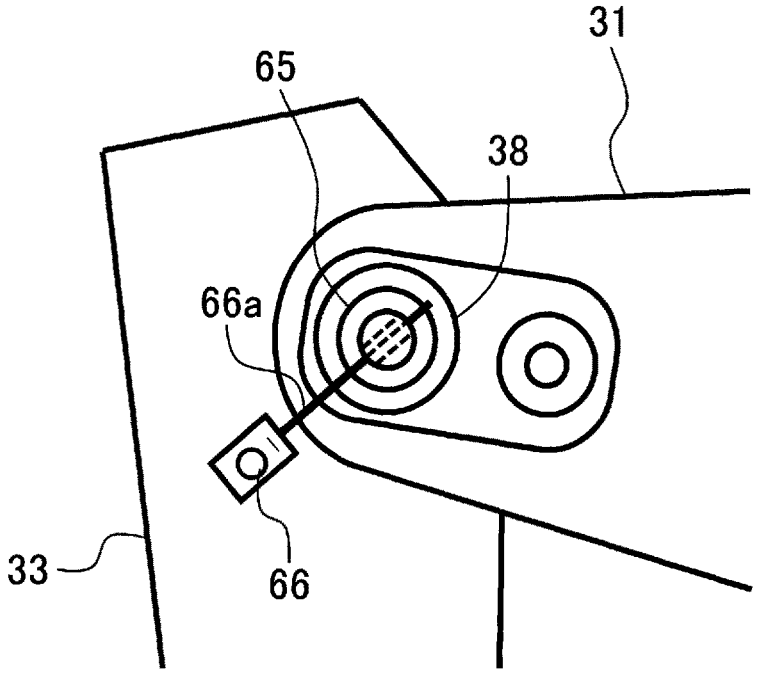
FIG. 6 is a view illustrating at an enlarged scale a joint of an arm to the boom.
Figure 7:
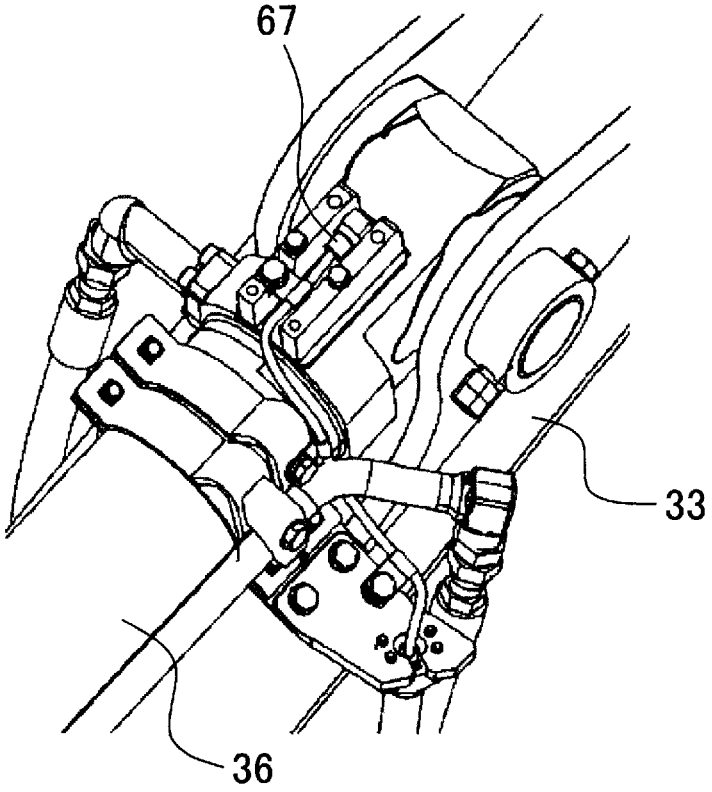
FIG. 7 is a view illustrating at an enlarged scale a joint of a bucket cylinder to the arm.

FIG. 5 is a view illustrating at an enlarged scale a joint of the boom to the upper swing structure. FIG. 6 is a view illustrating at an enlarged scale a joint of the arm to the boom. FIG. 7 is a view illustrating at an enlarged scale a joint of the bucket cylinder to the arm.

In FIG. 5, a boom angle sensor 63 as a posture sensor is positioned on the joint between the boom 31 and a swing frame 21 of the upper swing structure 20. The boom angle sensor 63 is disposed concentrically with the boom pin 37 on the swing frame 21. A boom angle sensor lever 64 is disposed on the boom 31 near the boom pin 37. A rod 64*a* projecting from the boom angle sensor lever 64 has an end extending through a detection shaft of the boom angle sensor 63. The detection shaft of the boom angle sensor 63 is disposed concentrically with the boom pin 37 for detecting a relative angular displacement of the boom 31 with respect to the swing frame 21 along a circumferential direction around the boom pin 37. When the boom 31 is angularly moved about the boom pin 37, the rod 64*a* of the boom angle sensor lever 64 angularly moves the detection shaft of the boom angle sensor 63. The boom angle sensor 63 can thus detect a relative angle of the boom 31 with respect to the swing frame 21 (hereinafter referred to as "boom angle") as posture information of the boom 31.

In FIG. 6, an arm angle sensor 65 as a posture sensor is positioned on the joint between the arm 33 and the boom 31. The arm angle sensor 65 is disposed concentrically with the arm pin 38 on the boom 31. An arm angle sensor lever 66 is disposed on the arm 33 near the arm pin 38. A rod 66*a* projecting from the arm angle sensor lever 66 has an end extending through a detection shaft of the arm angle sensor 65. The detection shaft of the arm angle sensor 65 is disposed concentrically with the arm pin 38 for detecting a relative angular displacement of the arm 33 with respect to the boom 31 along a circumferential direction around the arm pin 38. When the arm 33 is angularly moved about the arm pin 38, the rod 66*a* of the arm angle sensor lever 66 angularly moves the detection shaft of the arm angle sensor 66. The arm angle sensor 65 can thus detect a relative angle of the arm 33 with respect to the boom 31 (hereinafter referred to as "arm angle") as posture information of the arm 33.

In FIG. 7, a bucket cylinder stroke sensor 67 as a posture sensor is disposed on a bottom-side end of the bucket cylinder 36 (an end thereof on the joint to the boom 31). The bucket cylinder stroke sensor 67 is a magnetostrictive sensor based on the magnetostrictive effect, for example, and can detect a stroke position of the bucket cylinder 36. When the bucket cylinder 36 is extended or contracted, the bucket 35 is angularly moved about the bucket pin 39. The bucket cylinder stroke sensor 67 can calculate a relative angle of the bucket 35 with respect to the arm 33 (hereinafter referred to as "bucket angle") as posture information of the bucket 35 from the stroke position of the bucket cylinder 36.

According to the present embodiment, it has been illustrated that the angle sensors, i.e., the boom angle sensor 63 and the arm angle sensor 65, are used as posture sensors of the boom 31 and the arm 33, the bucket cylinder stroke sensor 67 is used as the posture sensor of the bucket 35, and posture information of the driven members 31, 33 and 35 is acquired from those sensors. However, the present invention is not limited to such details. At least one type of sensors including angle sensors disposed on the joints of the driven members 31, 33 and 35, stroke sensors disposed on the hydraulic actuators 32, 34 and 36, and tilt sensors disposed on the driven members 31, 33 and 35 may be selected and used as posture sensors corresponding respectively to the driven members 31, 33 and 35.

Reference will be made back to FIG. 1.

The lower track structure 10 includes a pair of crawlers 11*a* (11*b*) trained respectively around a pair of left and right crawler frames 12*a* (12*b*) and track hydraulic motors 13*a* (13*b*) (including speed reducer mechanisms, not depicted) for actuating the crawlers 11*a* (11*b*), respectively. In FIG. 1, one of the left and right ones of each of the pairs of the components of the lower track structure 10 is illustrated and indicated by a reference character, whereas the other is only indicated by a reference character in parentheses and omitted from illustration.

The upper swing structure 20 is made up of members disposed on the swing frame 21 used as a base. The swing frame 21 of the upper swing structure 20 is swingable with respect to the lower track structure 10. An operation room 170 that is occupied by the operator who operates the hydraulic excavator 1 with control lever devices 72, 73 and 74 (see FIG. 2) is disposed on the swing frame 21 of the upper swing structure 20. In addition, an engine 22 as a prime mover, a main hydraulic pump 41 and a pilot hydraulic pump 42 that are actuated by the engine 22, and a hydraulic circuit system 40 for operating the hydraulic actuators are disposed on the swing frame 21 of the upper swing structure 20. Furthermore, a machine body tilt sensor 68 for detecting a tilt of the machine body with respect to a horizontal plane is disposed on the upper swing structure 20.

In FIG. 3, the operation room 170 houses therein an operation seat 70 for the operator to sit in, the control lever devices 72, 73 and 74 for operating the front work implement 30, track levers (operation devices) 90 and 91 for operating the left and right track hydraulic motors 13*a* and 13*b* of the lower track structure 10, left and right track pedals 90*a* and 91*a* operable in ganged relation to the track levers 90 and 91, respectively, a gate lock lever 71 for selectively interrupting and opening delivery lines (pilot lines) of the pilot hydraulic pump 42, and switch panels 80 disposed respectively in the left and right sides of the operation room 170. A monitor (a display device) 61 for displaying various pieces of information, a setting screen, and so on is disposed in a position that can easily be seen by the operator in the operation room 170 and that does not obstruct the provision of an external field of view. The display on the monitor 61 is controlled by a monitor controller 62 that is controlled by a computer-aided construction controller 60 to be described later. Control levers 72*a* and 73*a* are provided as a single control lever shared by the control lever devices (operation devices) 72 and 73 for operating the boom cylinder 32 (the boom 31), and the bucket cylinder 36 (the bucket 35). If the control levers 72*a* and 73*a* are to be distinguished from each other, then they are referred to as a right control lever (boom) 72*a* and a left control lever (bucket) 73. Similarly, a control lever 74*a* is provided as a single control lever shared by the control lever device (operation device) 74 for operating the arm cylinder 34 (the arm 33) and a swing hydraulic motor, not depicted (the upper swing structure 20). If the control lever 74*a* is to be distinguished, it is referred to as a left control lever (arm) 74*a*. The track levers 90 and 91 are referred to as a left track lever 90 and a right track lever 91, respectively.

The switch panels 80 have a screen switching/determining switch 75 for switching between screens and selecting and determining items in a setting screen displayed on the monitor 61, a previous screen returning switch 79 for returning to and canceling a previous screen in the setting screen, a ten-key pad 78 for entering numerical values, an MC on/off switch 77 for selectively enabling (turning on), or disabling (turning off), machine control (to be described later) by the computer-aided construction controller 60 as a controller of the hydraulic excavator 1, and an MC standby switch 76 for enabling the MC on/off switch 77.

The screen switching/determining switch 75 and the previous screen returning switch 79 may be of a structure capable of selecting, determining, and canceling items in the setting screen. Alternatively, as illustrated in FIG. 4, for example, the screen switching/determining switch 75 may be a switch that can select items when rotated along circumferential directions and determine items when depressed, and the previous screen returning switch 79 may be a switch that can cancel a previous screen when depressed.

In the hydraulic circuit system according to the present embodiment in FIG. 2, control valves (spools) 100, 101 and 102 control the direction and flow rate of oil under pressure supplied from the main hydraulic pump 41 actuated by the engine 22 to the hydraulic actuators 32, 34 and 36. The oil under pressure delivered from the main hydraulic pump 41 is supplied through the control valves (spools) 100, 101 and 102 to the boom cylinder 32, the arm cylinder 34, and the bucket cylinder 36. The supplied oil under pressure extends or contracts the boom cylinder 32, the arm cylinder 34, and the bucket cylinder 36, thereby angularly moving the boom 31, the arm 33, and the bucket 35 to change the position and posture of the bucket 35. In FIG. 2, oil lines interconnecting the delivery line of the main hydraulic pump 41 and the control valves (spools) are omitted from illustration due to the limited space.

In FIG. 2, only the boom cylinder 32, the arm cylinder 34, and the bucket cylinder 36 with respect to the front work implement 30 are illustrated as the hydraulic actuators of the hydraulic excavator 1, and other actuators are omitted from illustration and description. However, the swing hydraulic motor is rotated by oil under pressure supplied through a control valve (a spool), not depicted, thereby swinging the upper swing structure 20 with respect to the lower track structure 10, and the track hydraulic motors 13*a* and 13*b* are rotated by supplied oil under pressure, thereby enabling the lower track structure 10 to travel. Although a fixed-displacement pump is illustrated as the main hydraulic pump 41 in the present embodiment, a variable-displacement whose displacement is controlled by a regulator may be used as the main hydraulic pump 41.

The pilot hydraulic pump 42 has a delivery line (a pilot line) extending through a gate lock valve 138 that is switched over by the gate lock lever 71 and branched into a plurality of lines connected to pressure bearing members (hydraulic actuating members) 100*a*, 100*b*, 101*a*, 101*b*, 102*a* and 102*b* of the control valves (spools) 100, 101 and 102 through the control lever devices 72, 73 and 74.

According to the present embodiment, the gate lock valve 138 is illustrated as a mechanical selector valve that is selectively opened and closed depending on the position of the gate lock lever 71 in the operation room 170. However, the gate lock lever may have a position sensor and the gate lock valve 138 may be a solenoid-operated selector valve that is selectively opened and closed by an electric actuator that is electrically connected to the position sensor. When the gate lock lever 71 is in a locked position, the gate lock valve 71 is closed, interrupting the delivery line (pilot line) from the pilot hydraulic pump 42. When the gate lock lever 71 is in an unlocked position, the gate lock valve 71 is open, opening the delivery line (pilot line) from the pilot hydraulic pump 42. When the delivery line (pilot line) from the pilot hydraulic pump 42 is interrupted, the control lever devices 72, 73 and 74 are disabled, inhibiting operating form the front work implement 30, e.g., excavating the ground (including turning), etc.

The control lever devices 72, 73 and 74 are of the hydraulic pilot type and generate pilot pressures (also referred to as "operation signals") from the oil under pressure delivered from the pilot hydraulic valve 42 depending on the extents (e.g., lever strokes) to and the directions in which the control levers 72*a* and 73*a*, 74*a* are operated by the operator. The generated pilot pressures are supplied to the hydraulic actuating members 100*a*, 100*b*, 101*a*, 101*b*, 102*a* and 102*b* of the corresponding control valves (spools) 100, 101 and 102 through the pilot lines, and are used as operation signals for actuating the control valves (spools) 100, 101 and 102.

A pilot line that interconnects the control lever device 74 and the hydraulic actuating member 100*a* of the control valve (arm spool) 100 includes a solenoid-operated proportional valve (an arm pushing speed reducing valve) 103 for reducing the pilot pressure from the control lever device 74 and applying the reduced pilot pressure to the hydraulic actuating member 100*a* based on an operation signal from the computer-aided construction controller 60. The pilot line branches off upstream of the arm pushing speed reducing valve 103 into another pilot line extending in bypassing relation to the arm pushing speed reducing valve 103 and connected to the hydraulic actuating member 100*a*. The other pilot line is branched off through an MC hydraulic selector valve (an arm pushing selector valve) 132 for supplying the pilot pressure from the control lever device 74 to the hydraulic actuating member 100*a* selectively through the pilot line that includes the arm pushing speed reducing valve 103 or through the other pilot line (a bypass). When the pilot pressure (operation signal) is applied to the hydraulic actuating member 100*a*, the oil under pressure from the main hydraulic pump 41 is supplied to the rod-side compartment of the arm cylinder 34, actuating the control valve (arm spool) 100 in a direction to contract the arm cylinder 34 thereby to push the arm.

A pilot line that interconnects the control lever device 74 and the hydraulic actuating member 100*b* of the control valve (arm spool) 100 includes a solenoid-operated proportional valve (an arm pulling speed reducing valve) 104 for reducing the pilot pressure from the control lever device 74 and applying the reduced pilot pressure to the hydraulic actuating member 100*b* based on an operation signal from the computer-aided construction controller 60. The pilot line branches off upstream of the arm pulling speed reducing valve 104 into another pilot line extending in bypassing relation to the arm pulling speed reducing valve 104 and connected to the hydraulic actuating member 100*b*. The other pilot line is branched off through an MC hydraulic selector valve (an arm pulling selector valve) 133 for supplying the pilot pressure from the control lever device 74 to the hydraulic actuating member 100*b* selectively through the pilot line that includes the arm pulling speed reducing valve 104 or through the other pilot line (a bypass). When the pilot pressure (operation signal) is applied to the hydraulic actuating member 100*b*, the oil under pressure from the main hydraulic pump 41 is supplied to the bottom-side compartment of the arm cylinder 34, actuating the control valve (arm spool) 100 in a direction to extend the arm cylinder 34 thereby to pull the arm.

A pilot line that interconnects the control lever device 72 and the hydraulic actuating member 101*a* of the control valve (boom spool) 101 includes a solenoid-operated proportional valve (a boom lowering speed reducing valve) 105 for reducing the pilot pressure from the control lever device 72 and applying the reduced pilot pressure to the hydraulic actuating member 101*a* based on an operation signal from the computer-aided construction controller 60. The pilot line branches off upstream of the boom lowering speed reducing valve 105 into another pilot line extending in bypassing relation to the boom lowering speed reducing valve 105 and connected to the hydraulic actuating member 101*a*. The other pilot line is branched off through an MC hydraulic selector valve (a boom lowering selector valve) 134 for supplying the pilot pressure from the control lever device 72 to the hydraulic actuating member 101*a* selectively through the pilot line that includes the boom lowering speed reducing valve 105 or through the other pilot line (a bypass). When the pilot pressure (operation signal) is applied to the hydraulic actuating member 101*a*, the oil under pressure from the main hydraulic pump 41 is supplied to the rod-side compartment of the boom cylinder 32, actuating the control valve (boom spool) 101 in a direction to contract the boom cylinder 32 thereby to lower the boom.

A pilot line that interconnects the control lever device 72 and the hydraulic actuating member 101*b* of the control valve (boom spool) 101 includes a shuttle valve 111 for selecting a higher one of the pilot pressure from the control lever device 72 and the pilot pressure from the delivery line of the pilot hydraulic pump 42 and guiding the selected pilot pressure to the hydraulic actuating member 101*b*. The delivery line of the pilot hydraulic pump 42 that is connected to the shuttle valve 111 includes a solenoid-operated proportional valve (a boom lifting speed increasing valve) 106 for reducing the pilot pressure from the pilot hydraulic pump 42 and guiding the reduced pilot pressure to the shuttle valve 111 based on an operation signal from the computer-aided construction controller 60. When the pilot pressure (operation signal) is applied to the hydraulic actuating member 101*b*, the oil under pressure from the main hydraulic pump 41 is supplied to the bottom-side compartment of the boom cylinder 32, actuating the control valve (boom spool) 101 in a direction to extend the boom cylinder 32 thereby to lift the boom.

A pilot line that interconnects the control lever device 73 and the hydraulic actuating member 102*a* of the control valve (bucket spool) 102 includes a solenoid-operated proportional valve (a bucket dumping speed reducing valve) 107 for reducing the pilot pressure from the control lever device 73 and applying the reduced pilot pressure to the hydraulic actuating member 102*a* based on an operation signal from the computer-aided construction controller 60. A shuttle valve 112 for selecting a higher one of the pilot pressure from the bucket dumping speed reducing valve 107 and the pilot pressure from the delivery line of the pilot hydraulic pump 42 and guiding the selected pilot pressure to the hydraulic actuating member 102*a* is disposed downstream of the bucket dumping speed reducing valve 107. The pilot line from the control lever device 73 branches off upstream of the bucket dumping speed reducing valve 107 into another pilot line extending in bypassing relation to the bucket dumping speed reducing valve 107 and the shuttle valve 112 and connected to the hydraulic actuating member 102*a*. The other pilot line is branched off through an MC hydraulic selector valve (a bucket dumping selector valve) 135 for supplying the pilot pressure from the control lever device 73 to the hydraulic actuating member 102*a* selectively through the pilot line that includes the bucket dumping speed reducing valve 107 and the shuttle valve 112 or through the other pilot line (a bypass). The delivery line of the pilot hydraulic pump 42 that is connected to the shuttle valve 112 includes a solenoid-operated proportional valve (a bucket dumping speed increasing valve) 108 for reducing the pilot pressure from the pilot hydraulic pump 42 and guiding the reduced pilot pressure to the shuttle valve 112 based on an operation signal from the computer-aided construction controller 60. When the pilot pressure (operation signal) is applied to the hydraulic actuating member 102*a*, the oil under pressure from the main hydraulic pump 41 is supplied to the rod-side compartment of the bucket cylinder 36, actuating the control valve (bucket spool) 102 in a direction to contract the bucket cylinder 36 thereby to actuate the bucket to drop soil.

A pilot line that interconnects the control lever device 73 and the hydraulic actuating member 102*b* of the control valve (bucket spool) 102 includes a solenoid-operated proportional valve (a bucket crowding speed reducing valve) 109 for reducing the pilot pressure from the control lever device 73 and applying the reduced pilot pressure to the hydraulic actuating member 102*b* based on an operation signal from the computer-aided construction controller 60. A shuttle valve 113 for selecting a higher one of the pilot pressure from the bucket crowding speed reducing valve 109 and the pilot pressure from the delivery line of the pilot hydraulic pump 42 and guiding the selected pilot pressure to the hydraulic actuating member 102*b* is disposed downstream of the bucket crowding speed reducing valve 109. The pilot line from the control lever device 73 branches off upstream of the bucket crowding speed reducing valve 109 into another pilot line extending in bypassing relation to the bucket crowding speed reducing valve 109 and the shuttle valve 113 and connected to the hydraulic actuating member 102*b*. The other pilot line is branched off through an MC hydraulic selector valve (a bucket crowding selector valve) 136 for supplying the pilot pressure from the control lever device 73 to the hydraulic actuating member 102*b* selectively through the pilot line that includes the bucket crowding speed reducing valve 109 and the shuttle valve 113 or through the other pilot line (a bypass). The delivery line of the pilot hydraulic pump 42 that is connected to the shuttle valve 113 includes a solenoid-operated proportional valve (a bucket crowding speed increasing valve) 110 for reducing the pilot pressure from the pilot hydraulic pump 42 and guiding the reduced pilot pressure to the shuttle valve 113 based on an operation signal from the computer-aided construction controller 60. When the pilot pressure is applied to the hydraulic actuating member 102*b*, the oil under pressure from the main hydraulic pump 41 is supplied to the bottom-side compartment of the bucket cylinder 36, actuating the control valve (bucket spool) 102 in a direction to extend the bucket cylinder 36 thereby to actuate the bucket to excavate soil.

An MC hydraulic shut-off valve 131 for selectively passing and interrupting the pilot pressure from the pilot hydraulic pump 42 to the solenoid-operated proportional valves 106, 108 and 110 is disposed upstream of the solenoid-operated proportional valves 106, 108 and 110 (connected to the pilot hydraulic pump 42). When the MC hydraulic shut-off valve 131 is switched to pass the pilot pressure, the pilot pressure is guided from the pilot hydraulic pump 42 to the solenoid-operated proportional valves 106, 108 and 110. When the MC hydraulic shut-off valve 131 is switched to interrupt the pilot pressure, the pilot pressure supplied from the pilot hydraulic pump 42 to the solenoid-operated proportional valves 106, 108 and 110 is interrupted.

The MC hydraulic selector valves 132, 133, 134, 135 and 136 and the MC hydraulic shut-off valve 131 are switched based on the pilot valve guided from the pilot hydraulic pump 42 through an MC solenoid-operated on/off valve 130. The MC solenoid-operated on/off valve 130 selectively passes and interrupts the pilot pressure (operation signal) for actuating the MC hydraulic selector valves 132, 133, 134, 135 and 136 and the hydraulic shut-off valve 131 based on an operation signal (current) from the computer-aided construction controller 60.

When the pilot pressure guided to respective pressure bearing members 132*a*, 133*a*, 134*a*, 135*a* and 136*a* of the MC hydraulic selector valves 132, 133, 134, 135 and 136 is interrupted, the MC hydraulic selector valves 132, 133, 134, 135 and 136 switch the pilot pressure from the control lever devices 72, 73 and 74 to the bypassing pilot lines. When the pilot pressure is applied to the pressure bearing members 132*a*, 133*a*, 134*a*, 135*a* and 136*a*, the MC hydraulic selector valves 132, 133, 134, 135 and 136 switch the pilot pressure from the control lever devices 72, 73 and 74 to the pilot lines that include the solenoid-operated proportional valves 103, 104, 105, 107 and 109.

When the pilot pressure guided to a pressure bearing member 131*a* of the MC hydraulic shut-off valve 131 is interrupted, the MC hydraulic shut-off valve 131 interrupts the pilot pressure supplied from the pilot hydraulic pump 42 to the solenoid-operated proportional valves 106, 108 and 110. When the pilot pressure is applied to the pressure bearing member 131*a*, the MC hydraulic shut-off valve 131 supplies the pilot pressure from the pilot hydraulic pump 42 to the solenoid-operated proportional valves 106, 108 and 110.

The pilot pressure through the MC solenoid-operated on/off valve 130 that selectively passes and interrupts the pilot pressure based on an operation signal from the computer-aided construction controller 60 is guided to the pressure-bearing members 131*a*, 132*a*, 133*a*, 134*a*, 135*a* and 136*a* of the MC hydraulic shut-off valve 131 and the MC hydraulic selector valves 132, 133, 134, 135 and 136. The opening of the MC solenoid-operated on/off valve 130 is zero when it is de-energized, and maximum when it is energized. Therefore, when the computer-aided construction controller 60 outputs an operation signal (current) to actuate the solenoid-operated on/off valve 130, the solenoid-operated proportional valves 103, 104, 105, 107 and 109 are rendered effective to reduce a pilot pressure (operation signal), and the solenoid-operated proportional valves 106, 108 and 110 are rendered effective to generate a pilot pressure (operation signal).

The opening of the solenoid-operated proportional valves 103, 104, 105, 107 and 109 is maximum when they are de-energized, and decreases as the current (operation signal) from the computer-aided construction controller 60 increases. On the other hand, the opening of the solenoid-operated proportional valves 106, 108 and 110 is zero when they are de-energized. When the solenoid-operated proportional valves 106, 108 and 110 are energized, they are open, and their opening increases as the current (operation signal) from the computer-aided construction controller 60 increases. In this manner, the opening of each of these solenoid-operated proportional valves is controlled by the current (operation signal) from the computer-aided construction controller 60. Consequently, when the computer-aided construction controller 60 outputs an operation signal (current) to actuate the solenoid-operated proportional valves 106, 108 and 110, even if the corresponding control lever devices 72 and 73 are not operated by the operator, the solenoid-operated proportional valves 106, 108 and 110 generate a pilot pressure (operation signal) and apply the generated pilot pressure (operation signal) to the hydraulic actuating members 101*b*, 102*a* and 102*b*, thereby forcibly making a boom lifting movement and a bucket crowding/dumping movement. Similarly, when the computer-aided construction controller 60 outputs an operation signal (current) to actuate the solenoid-operated proportional valves 103, 104, 105, 107 and 109, the solenoid-operated proportional valves 103, 104, 105, 107 and 109 generate a pilot pressure (operation signal) from which the pilot pressure generated when the operator operates the control lever devices 72, 73 and 74 is reduced, and apply the generated pilot pressure (operation signal) to the hydraulic actuating members 100*a*, 100*b*, 101*a*, 102*a* and 102*b*, thereby forcibly reducing the speed of a boom lowering movement, an arm crowding/dumping movement, and a bucket crowing/dumping movement from the speed based on the extent to which the control levers 72*a* and 73*a*, 74*a* are operated by the operator.

According to the present embodiment, of the operation signals (pilot pressures) for the control valves 100, 101 and 102, those pilot pressures which are generated when the control lever devices 72, 73 and 74 are operated are referred to as "first operation signals" or "primary pressures." Furthermore, of the operation signals (pilot pressures) for the control valves 100, 101 and 102, those pilot pressures which are generated by correcting (reducing, the first operation signals by actuating the solenoid-operated proportional valves 103, 104, 105, 107 and 109 with the computer-aided construction controller 60 and applied to the hydraulic actuating members 100*a*, 100*b*, 101*a*, 101*b*, 102*a* and 102*b* and those pilot pressures which are newly generated separately from the first operation signals by actuating the solenoid-operated proportional valves 106, 108 and 110 with the computer-aided construction controller 60 and applied to the hydraulic actuating members 101*b*, 102*a* and 102*b* are referred to as "second operation signals" or "secondary pressures."

The computer-aided construction controller 60 has a calibration posture storing section 60*a*, a calibration posture controlling section 60*b*, and a machine control controlling section 60*c*.

To the computer-aided construction controller 60, there are input a detected result from a shut-off valve outlet pressure sensor 137 that detects the pilot pressure downstream of the gate lock valve 138, detected results from an arm pushing pilot pressure primary pressure sensor 118, an arm pulling pilot pressure primary pressure sensor 119, an arm lowering pilot pressure primary pressure sensor 120, a boom lifting pilot pressure primary pressure sensor 121, a bucket dumping pilot pressure primary pressure sensor 122, and a bucket crowding pilot pressure primary pressure sensor 123 that detect the primary pressures of the pilot pressures output when the control lever devices 72, 73 and 74 are operated, detected results from an arm pushing pilot pressure secondary pressure sensor 124, an arm pulling pilot pressure secondary pressure sensor 125, a boom lowering pilot pressure secondary pressure sensor 126, a boom lifting pilot pressure secondary pressure sensor 127, a bucket dumping pilot pressure secondary pressure sensor 128, and a bucket crowding pilot pressure secondary pressure sensor 129 that detect the secondary pressures of the pilot pressures applied to the hydraulic actuating members 100*a*, 100*b*, 101*a*, 101*b*, 102*a* and 102*b* of the control valves or spools 100, 101 and 102, and detected results from the boom angle sensor 63, the arm angle sensor 65, the bucket cylinder stroke sensor 67, and the machine body tilt sensor 68 as posture sensors that acquire posture information about the postures of the front work implement 30 and the machine body. Furthermore, operation signals from the screen switching/determining switch 75, the MC standby switch 76, the MC on/off switch 77, the ten-key pad 78, and the previous screen returning switch 79 are input to the computer-aided construction controller 60.

When the MC standby switch 76 is operated (depressed) inputting an operation signal (a contact signal) to the computer-aided construction controller 60, the computer-aided construction controller 60 enables the MC on/off switch 77 to input an operation signal (a contact signal) to the computer-aided construction controller 60. While the MC on/off switch 77 is enabled by the operation (the depression) of the MC standby switch 76, when the MC on/off switch 77 is operated (depressed) to input an operation signal (a contact signal) the computer-aided construction controller 60 outputs an operation signal (a current) to the MC solenoid-operated on/off valve 130 to actuate the MC solenoid-operated on/off valve 130 to pass the pilot pressure, enabling the solenoid-operated proportional valves 103, 104, 105, 107 and 109 to reduce the pilot pressure (the operation signal) and also enabling the solenoid-operated proportional valves 106, 108 and 110 to generate the pilot pressure (the operation signal). In other words, when the MC standby switch 76 and the MC on/off switch 77 are operated, the machine control in the hydraulic excavator 1 is enabled.

The machine control controlling section 60*c* controls the machine control (MC) of the front work implement 30 of the hydraulic excavator 1. The machine control according to the present embodiment refers to a control process for assisting the operator in an excavating operation by calculating the posture of the front work implement 30 in a local coordinate system (a coordinate system established with respect to the hydraulic excavator 1) and the position of the claw tip of the bucket 35 based on detected results from the boom angle sensor 63, the arm angle sensor 65, the bucket cylinder stroke sensor 67, and the machine body tilt sensor 68 as posture sensors, and forcibly operating at least some of the hydraulic actuators 32, 34 and 36 or limiting the operation of at least some of the hydraulic actuators 32, 34 and 36 in order to cause the front work implement 30 to operate according to predetermined conditions with respect to excavating actions entered through the control lever devices 72, 73 and 74. One specific example of the machine control is to automatically control the boom cylinder 32 to add a boom lifting operation during an excavating operation controlled by the operator, thereby limiting the position of the distal end of the bucket 35 onto a target surface.

The calibration posture storing section 60*a* and the calibration posture controlling section 60*b* perform a "calibration posture controlling process," (a kind of machine control) for semiautomatically adjusting the posture of the front work implement 30 to a posture required to perform a calibration work (a calibration posture) in carrying out a calibration process for at least some of the posture sensors (the boom angle sensor 63, the arm angle sensor 65, the bucket cylinder stroke sensor 67) related to the accuracy of the machine control. In the calibration posture controlling process, the calibration posture storing section 60*a* stores at least one calibration posture (a plurality of calibration postures in the present embodiment) of the front work implement 30 which is predetermined for calibrating the posture sensors 63, 65 and 67 (performs a calibration posture setting storing process) and the calibration posture controlling section 60*b* performs the machine control to stop the hydraulic actuators 32, 34 and 36 if detection target values (angle target values) for the posture sensors 63, 65 and 67 that are preset depending on one calibration posture selectively set among the plurality of calibration postures and detected values from the posture sensors 63, 65 and 67 are equal to each other (performs a calibration posture controlling process).

Figure 8:
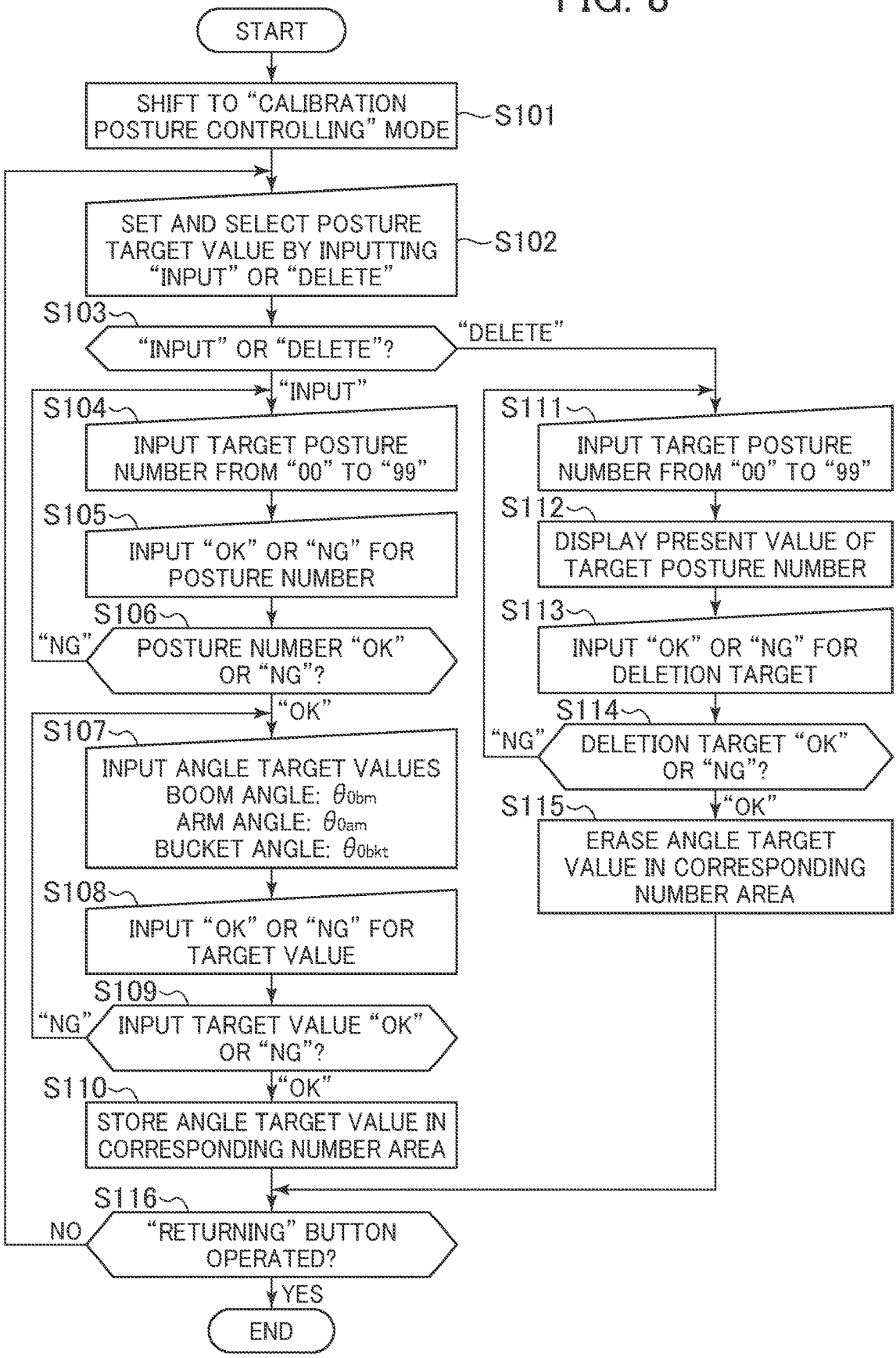
FIG. 8 is a flowchart illustrating a calibration posture setting storing process of a calibration posture storing section.

FIG. 8 is a flowchart illustrating a calibration posture setting storing process of the calibration posture storing section. FIGS. 11 through 17 are views illustrating examples of screen displayed on the monitor in processing steps of the calibration posture setting storing process.

In FIG. 8, the calibration posture storing section 60*a* starts the calibration posture setting storing process when a menu screen 140 (FIG. 11) displayed on the monitor 61 is operated to shift to a calibration posture controlling mode (step S101). The shifting to the calibration posture controlling mode is determined by, for example, turning the screen switching/determining switch 75 from the menu screen 140 displayed on the monitor 61 to select an item 140*a* "CALIBRATION POSTURE" representing the calibration posture controlling mode and depressing the screen switching/determining switch 75.

When shifted to the calibration posture controlling mode, the calibration posture storing section 60*a* controls the monitor controller 62 to display a posture input screen 141 (FIG. 12) on the monitor 61, prompting the operator to selectively set either an item 141*a* "INPUT" for storing a new calibration posture or an item 141*b* "DELETE" for deleting a calibration posture that has been stored in the past (step S102), and determines which one of the item 141*a* "INPUT" and the item 141*b* "DELETE" is set (step S103). The setting of the item 141*a* "INPUT" or the item 141*b* "DELETE" is determined by turning the screen switching/determining switch 75 from the posture input screen 141 displayed on the monitor 61 to select the item 141*a* "INPUT" or the item 141*b* "DELETE" and depressing the screen switching/determining switch 75.

If it is determined in step S103 that the item "INPUT" has been set, then the calibration posture storing section 60*a* controls the monitor controller 62 to display a posture number indicating screen 142 (FIG. 13) on the monitor 61, prompting the operator to indicate a posture number where a new calibration posture is to be stored (step S104). The indication of a posture number is determined by, for example, turning the screen switching/determining switch 75 from the posture number indicating screen 142 displayed on the monitor 61 to selectively switch and select one of posture numbers "00" through "99" for a posture number item 142*a* or directly inputting a posture number from the ten-key pad 78, and depressing the screen switching/determining switch 75. According to the present embodiment, the range of the posture numbers "00" through "99" is illustrated. However, the present invention is not limited to such details, but any desired item number may be set depending on the necessity and the capacity of a storage area of the controller.

Then, the calibration posture storing section 60*a* controls the monitor controller 62 to display a screen on the monitor 61, not depicted, for confirming whether or not the input posture number is not wrong, prompting the operator to enter whether the indicated posture number is correct or not (whether "OK" or "NG") is input (step S105), and determines which one of "OK" and "NG" is input (step S106). The inputting of whether or not the posture number is not wrong may be determined by, for example, turning the screen switching/determining switch 75 to select one of the alternatives "OK"/"NG" displayed on the confirming screen displayed on the monitor 61, and depressing the screen switching/determining switch 75. Alternatively, "OK" may be input by turning the screen switching/determining switch 75 to select an item 142*b* for a "tick" (a check mark) on the posture number indicating screen 142 (FIG. 13), and depressing the screen switching/determining switch 75, or "NG" may be input by depressing the previous screen returning switch 79. If it is determined in step S106 that "NG" is input, then the processing of steps S104, S105 is repeated until "OK" is input.

If it is determined in step S106 that "OK" is input, then the calibration posture storing section 60*a* controls the monitor controller 62 to display a posture target value input screen 143 (FIG. 14) on the monitor 61, prompting the operator to input posture information (posture target values) of the new calibration posture (step S107). Angle target values to be input for the driven members 31, 33 and 35 are herein illustrated as the posture information. The inputting of the posture information is determined by, for example, turning the screen switching/determining switch 75 from the posture target value input screen 143 displayed on the monitor 61 to select either one of an item 143*a* "BOOM ANGLE," an item 143*b* "ARM ANGLE," and an item 143*c* "BUCKET ANGLE" as an item of an input target, depressing the screen switching/determining switch 75 to determine the selected item and display a screen 144 (FIG. 15), thereafter turning the screen switching/determining switch 75 to selectively switch and select an item 144*a* of posture information (angle target values) of an input target from a plurality of candidate values, or directly inputting an item 144*a* of posture information (angle target values) into an item 144*a* from the ten-key pad 78, and depressing the screen switching/determining switch 75.

Then, the calibration posture storing section 60*a* controls the monitor controller 62 to display a screen on the monitor 61 (not depicted) for confirming whether or not the input posture information (the angle target values) is not wrong, prompting the operator to enter whether the input posture information is correct or not (whether "OK" or "NG") is input (step S108), and determines which one of "OK" and "NG" is input (step S109). The inputting of whether or not the posture information is not wrong may be determined by, for example, turning the screen switching/determining switch 75 to select one of the alternatives "OK"/"NG"

displayed on the confirming screen displayed on the monitor 61, and depressing the screen switching/determining switch 75. Alternatively, "OK" may be input by turning the screen switching/determining switch 75 to select an item 144*b* for a "tick" (a check mark) on the screen 144 (FIG. 15), and depressing the screen switching/determining switch 75, or "NG" may be input by depressing the previous screen returning switch 79. If it is determined in step S109 that "NG" is input, then the processing of steps S107 and S108 is repeated until "OK" is input.

If it is determined in step S109 that "OK" is input, then the posture information (the angle target values) input in a storage area corresponding to the posture number selected in step S104, among a plurality of storage areas in the calibration posture storing section 60*a*, is stored (step S110).

If it is determined in step S103 that the item "DELETE" has been set, then the calibration posture storing section 60*a* controls the monitor controller 62 to display a calibration posture deleting screen 145 (FIG. 16) on the monitor 61, prompting the operator to indicate the posture number of a calibration posture to be deleted (step S111). The indication of the posture number to be deleted is determined by, for example, turning the screen switching/determining switch 75 from the posture deleting screen 145 displayed on the monitor 61 to selectively switch and select one of the posture numbers "00" through "99" for a posture number item 145*a* or directly inputting a posture number from the ten-key pad 78, and depressing the screen switching/determining switch 75.

When the posture number of a calibration posture to be deleted is indicated in step S111, the calibration posture storing section 60*a* controls the monitor controller 62 to display a screen 146 (FIG. 17) for displaying the present value of the calibration posture to be deleted (S112), prompting the operator to input whether the posture number input as a deletion target is correct or not (whether "OK" or "NG") (step S113), and determines which one of "OK" and "NG" is input (step S114). The inputting of whether or not the posture number input as the deletion target is not wrong may be determined by, for example, turning the screen switching/determining switch 75 to select one of the alternatives "OK"/"NG" displayed on the confirming screen displayed on the monitor 61, and depressing the screen switching/determining switch 75. Alternatively, "OK" may be input by turning the screen switching/determining switch 75 to select an item 146*a* for a tick (a check mark) on the posture number indicating screen 146 (FIG. 17), and depressing the screen switching/determining switch 75, or "NG" may be input by depressing the previous screen returning switch 79.

If it is determined in step S114 that "OK" is input, then the posture information (the angle target values) input in a storage area corresponding to the posture number selected as the deletion target in step S111, among the plurality of storage areas in the calibration posture storing section 60*a*, is erased (step S115).

When the storing process of step S110 or the erasing process of step S115 is finished, the calibration posture storing section 60*a* determines whether the previous screen returning switch 79 is depressed or not. If the determined result is NO, then the processing of steps S102 through 115 is repeated. If the determined result is YES, then the processing sequence is ended.

Figure 9:
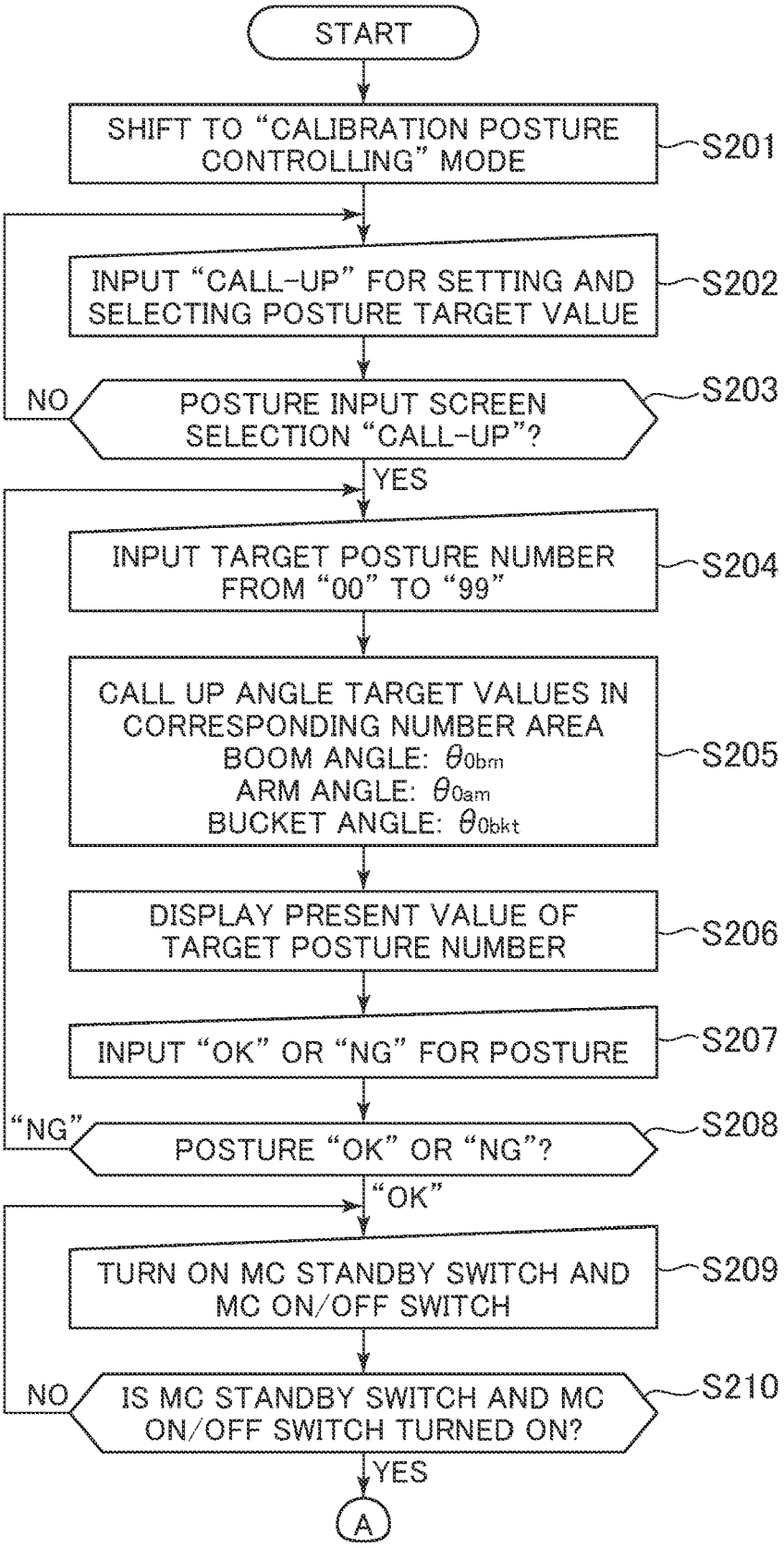
FIG. 9 is a flowchart illustrating a calibration posture controlling process of a calibration posture controlling section.
Figure 10:
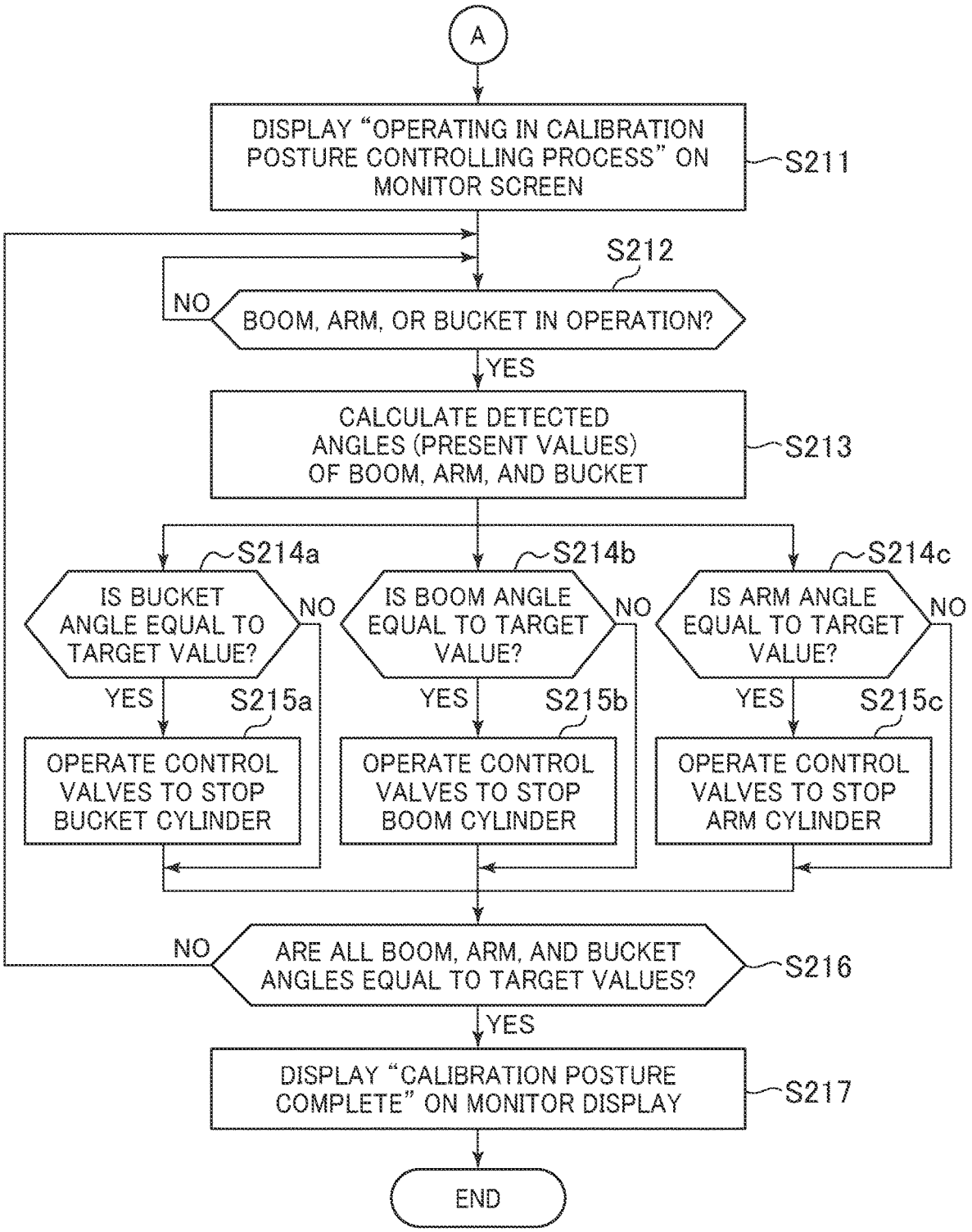
FIG. 10 is a flowchart illustrating the calibration posture controlling process of the calibration posture control section.
Figure 11:
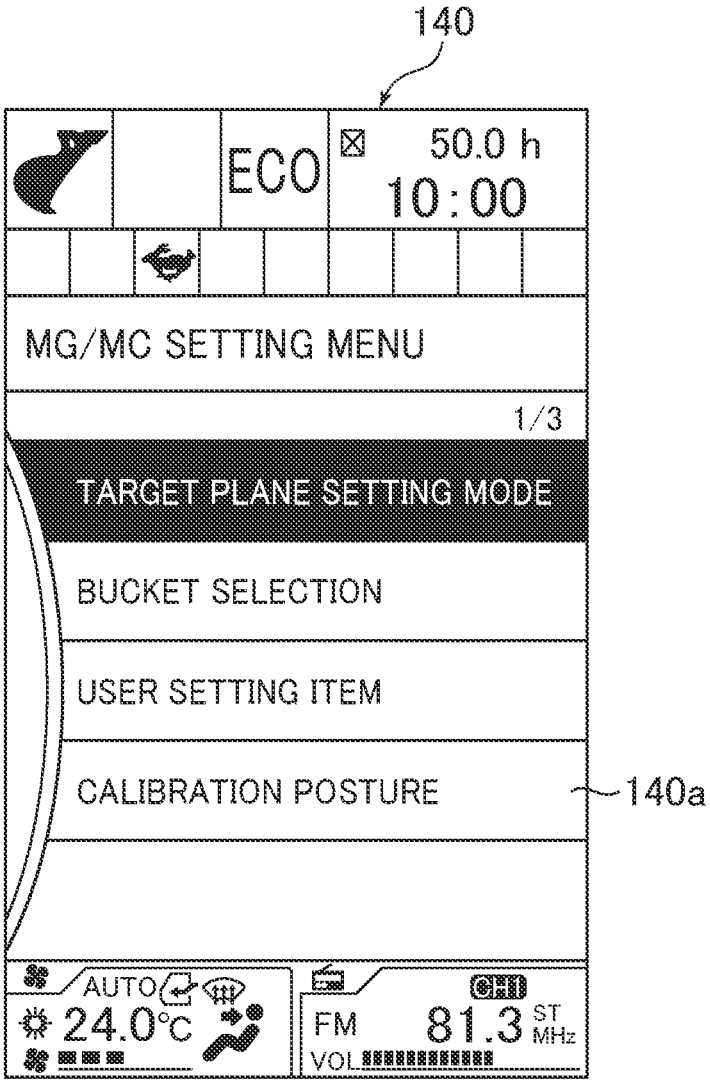
FIG. 11 is a view illustrating an example of screen displayed on a monitor in a processing step of the calibration posture setting storing process.
Figure 12:
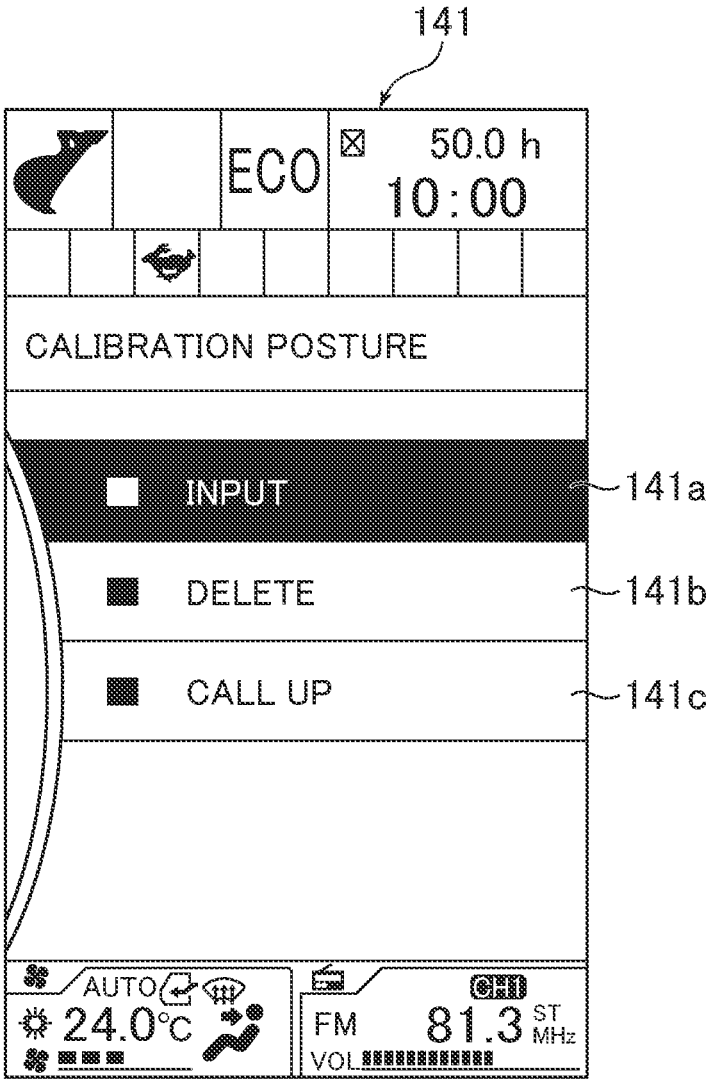
FIG. 12 is a view illustrating an example of screen displayed on the monitor in a processing step of the calibration posture setting storing process.
Figure 13:
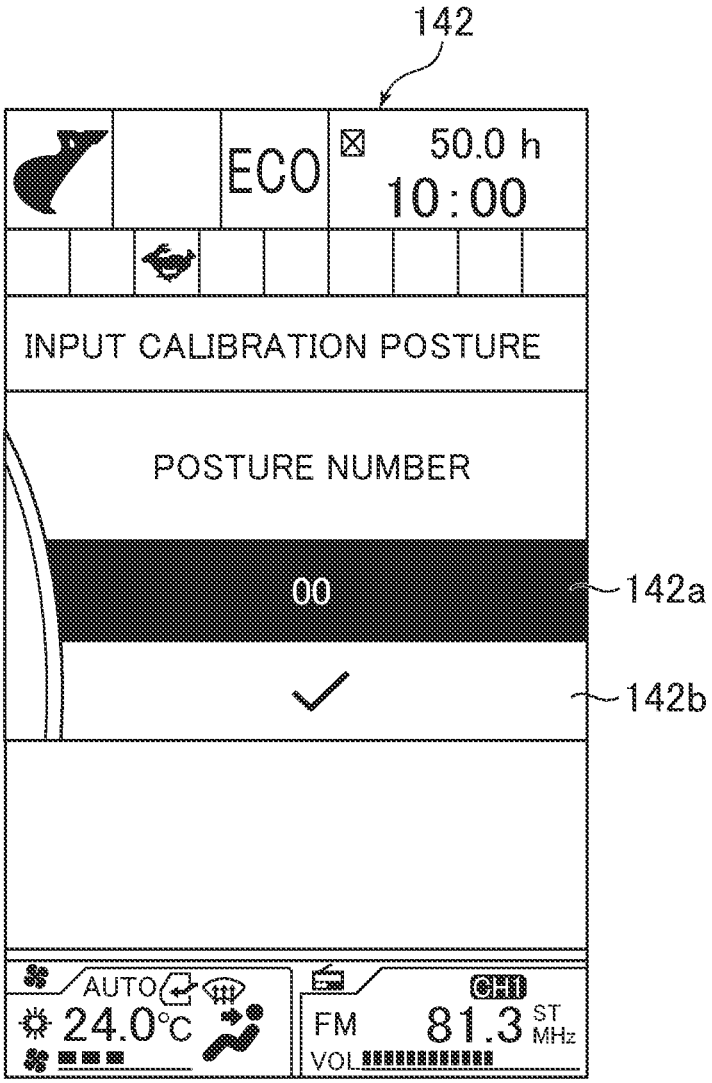
FIG. 13 is a view illustrating an example of screen displayed on the monitor in a processing step of the calibration posture setting storing process.
Figure 14:
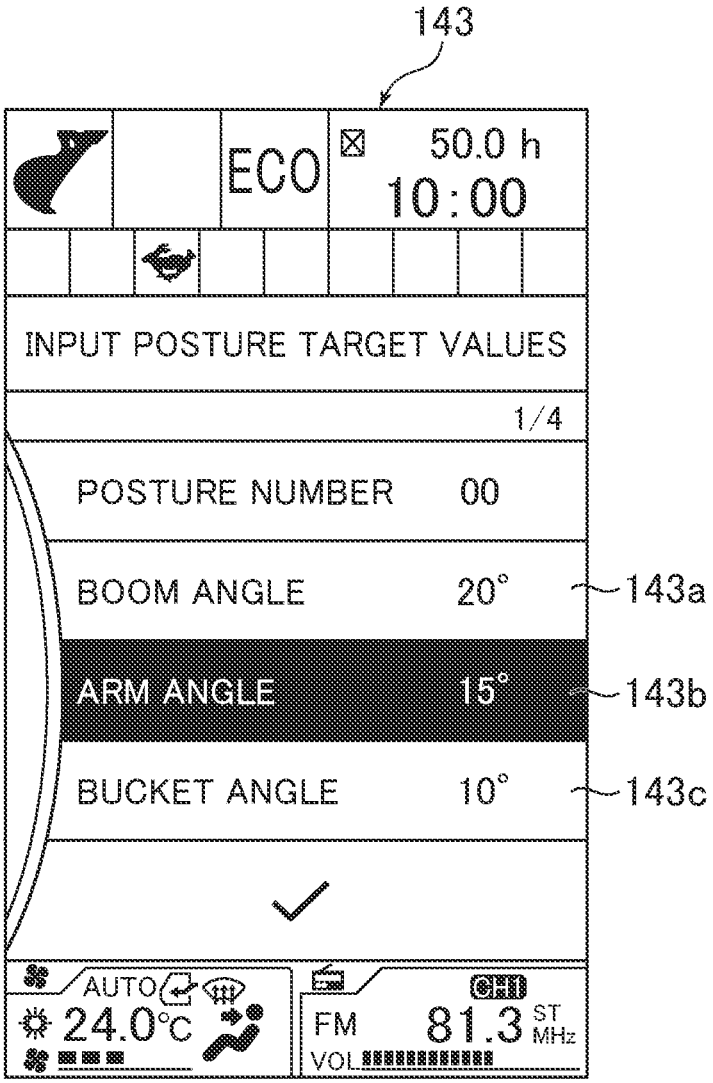
FIG. 14 is a view illustrating an example of screen displayed on the monitor in a processing step of the calibration posture setting storing process.
Figure 15:
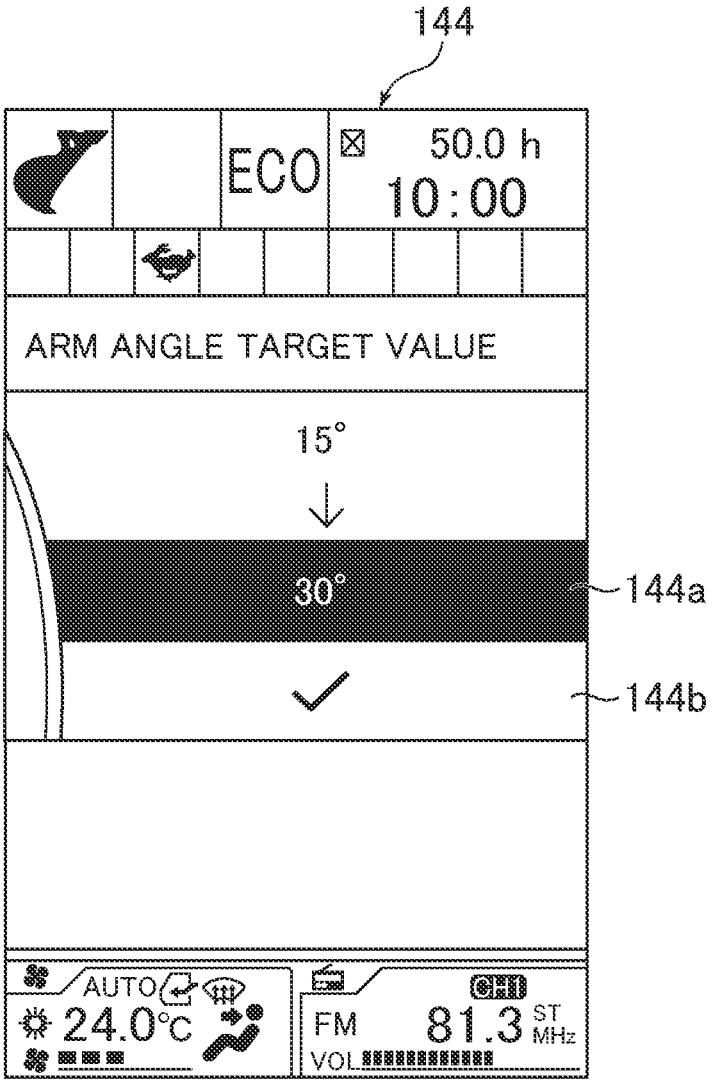
FIG. 15 is a view illustrating an example of screen displayed on the monitor in a processing step of the calibration posture setting storing process.
Figure 16:
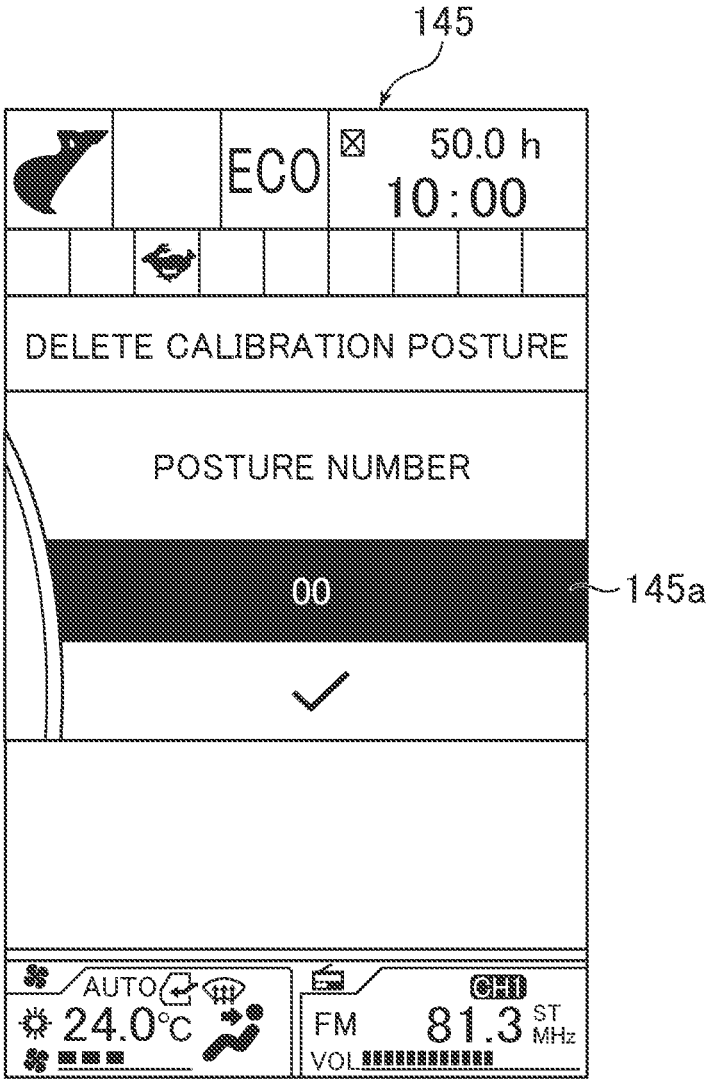
FIG. 16 is a view illustrating an example of screen displayed on the monitor in a processing step of the calibration posture setting storing process.
Figure 17:
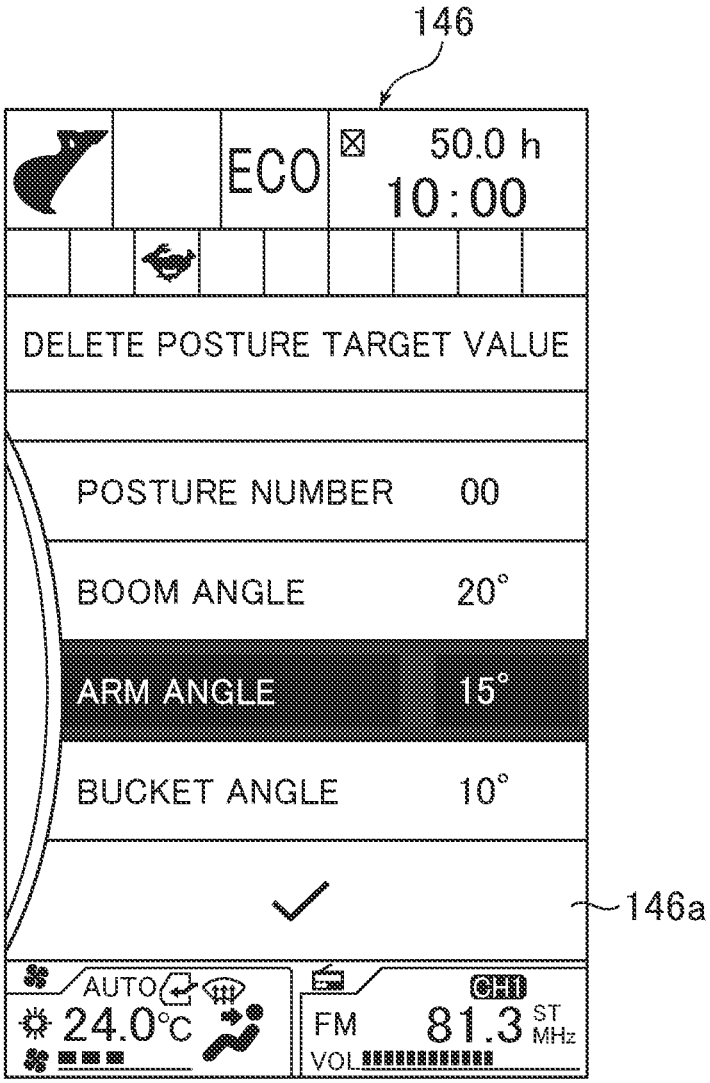
FIG. 17 is a view illustrating an example of screen displayed on the monitor in a processing step of the calibration posture setting storing process.
Figure 18:
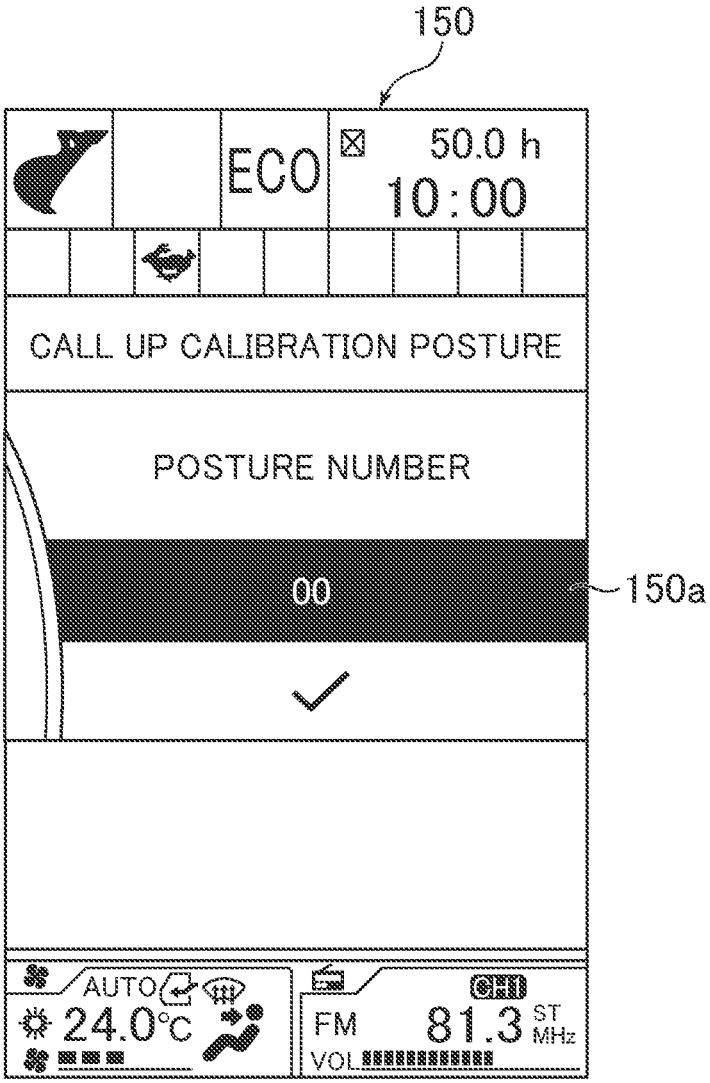
FIG. 18 is a view illustrating an example of screen displayed on the monitor in a processing step of the calibration posture controlling process.
Figure 19:
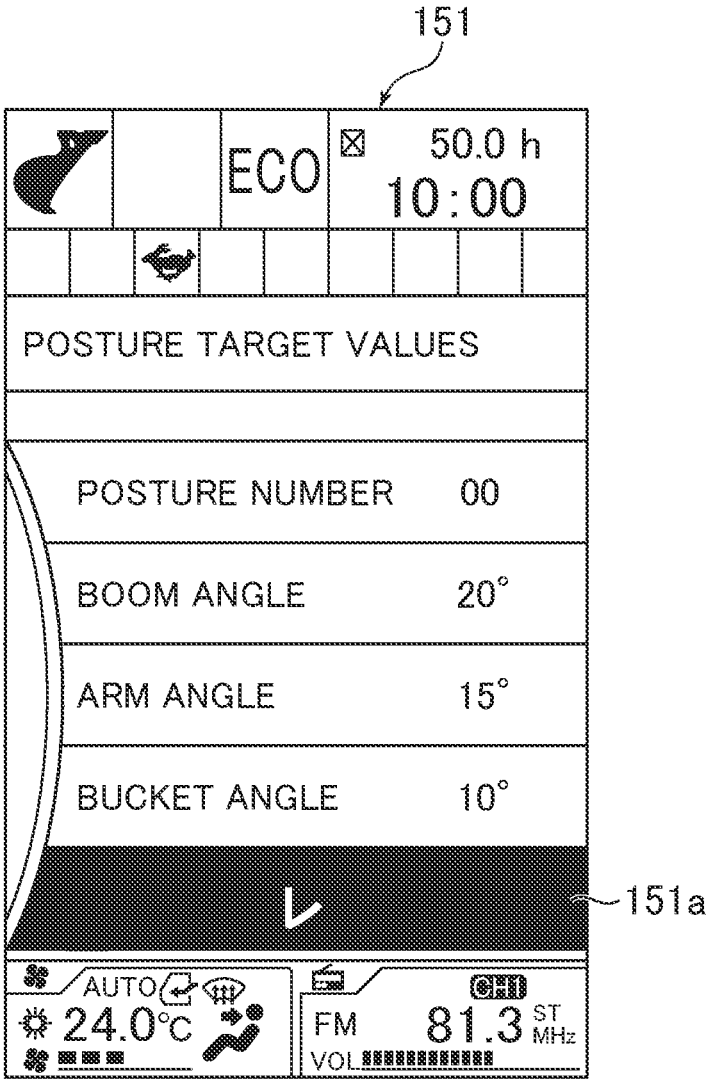
FIG. 19 is a view illustrating an example of screen displayed on the monitor in a processing step of the calibration posture controlling process.
Figure 20:
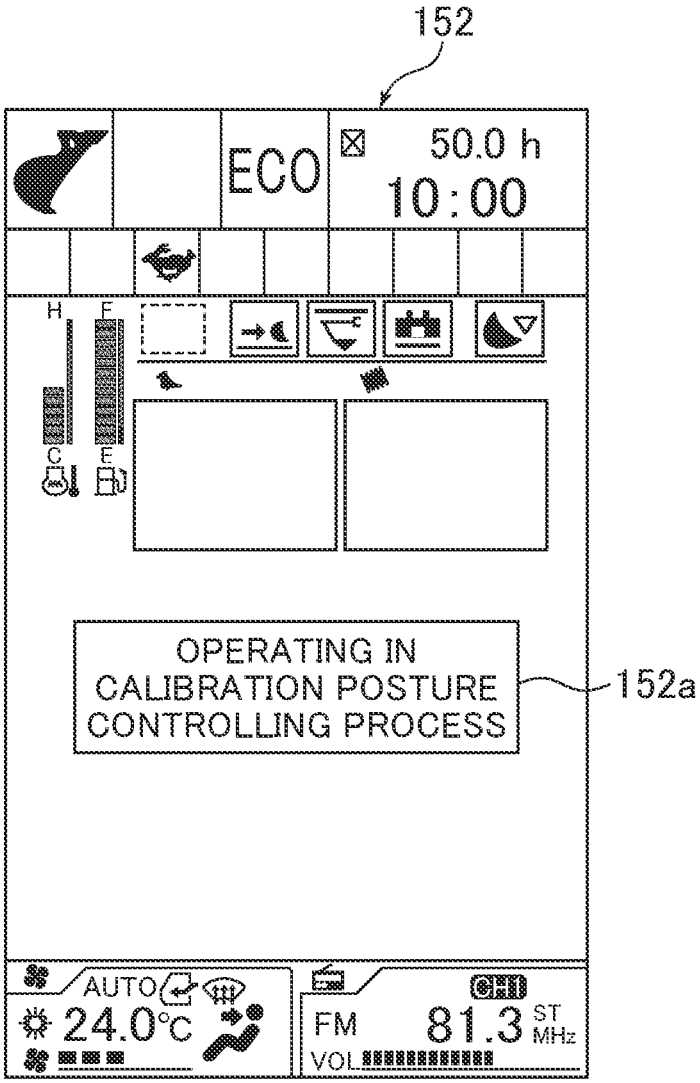
FIG. 20 is a view illustrating an example of screen displayed on the monitor in a processing step of the calibration posture controlling process.
Figure 21:
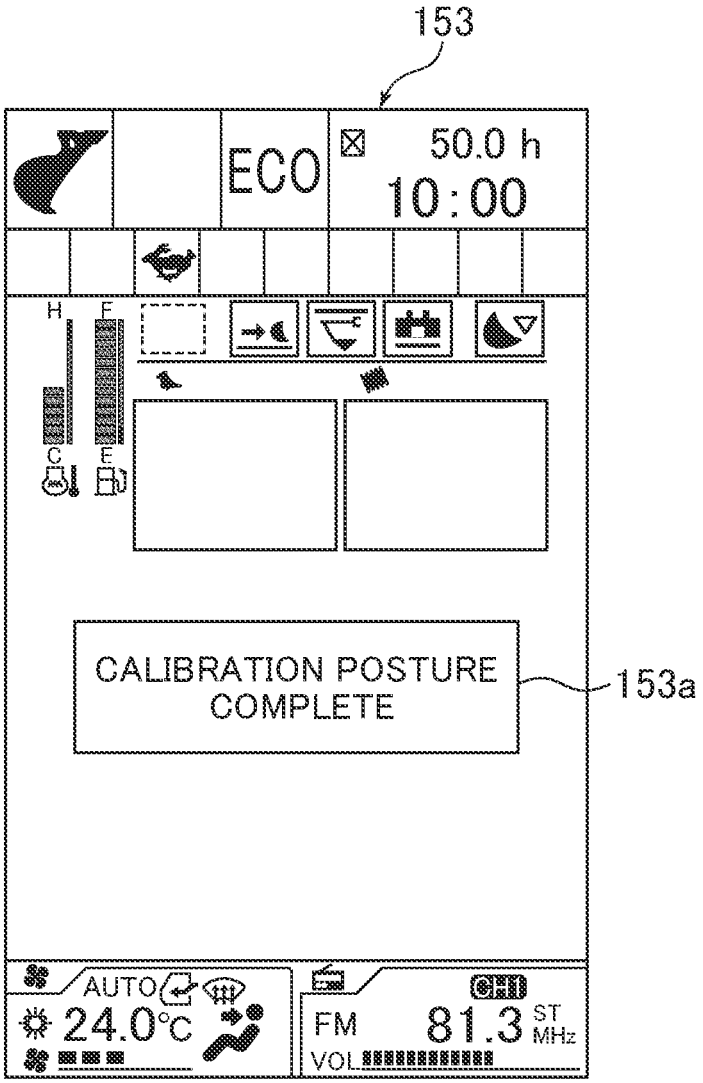
FIG. 21 is a view illustrating an example of screen displayed on the monitor in a processing step of the calibration posture controlling process.

FIGS. 9 and 10 are flowcharts illustrating the calibration posture controlling process of the calibration posture controlling section. FIGS. 18 through 21 are views illustrating examples of screen displayed on the monitor in the processing steps of the calibration posture controlling process. Of the screens displayed on the monitor in the calibration posture controlling process, those which are in common with the screens displayed on the monitor in the calibration posture setting storing process will be omitted from illustration though their figure numbers are indicated.

In FIG. 9, when the menu screen 140 (FIG. 11) displayed on the monitor 61 is operated to shift to the calibration posture controlling mode, the calibration posture controlling section 60*b* starts the calibration posture setting storing process (step S201). The shifting to the calibration posture controlling mode is determined by, for example, turning the screen switching/determining switch 75 from the menu screen 140 displayed on the monitor 61 to select the item 140*a* "CALIBRATION POSTURE" representing the calibration posture controlling mode and depressing the screen switching/determining switch 75.

When shifted to the calibration posture controlling mode, the calibration posture storing section 60*a* controls the monitor controller 62 to display the posture input screen 141 (FIG. 12) on the monitor 61, prompting the operator to selectively input an item 141*c* "CALL UP" for calling up a calibration posture (step S202), and determines whether the item 141*c* "CALL UP" is input or not (step S203). The inputting of the item 141*c* "CALL UP" is determined by turning the screen switching/determining switch 75 to from the posture input screen 141 displayed on the monitor 61 to select the item 141*c* "CALL UP," and depressing the screen switching/determining switch 75. If the determined result from step S203 is NO, then the processing of step S202 is repeated until the determined result becomes YES, i.e., until the item 141*c* "CALL UP" is input in the posture input screen 141.

If the determined result from step S203 is YES, then the calibration posture storing section 60*a* controls the monitor controller 62 to display a posture number indicating screen 150 (FIG. 18) for calling up a calibration posture on the monitor 61, prompting the operator to indicate the posture number of a calibration posture to be called up (step S204). The indicating of the posture number is determined by, for example, turning the screen switching/determining switch 75 from the posture number indicating screen 150 displayed on the monitor 61 to select a posture number item 150*a* from the posture numbers "00" through "99," or directly inputting a posture number from the ten-key pad 78, and depressing the screen switching/determining switch 75.

When the posture number of a calibration posture to be called up is indicated in step S204, the calibration posture storing section 60*a* calls up the posture information (the angle target values, stored in the storage area corresponding to the posture number indicated in step S204, among the plurality of storage areas in the calibration posture storing section 60*a* (step S205), controls the monitor controller 62 to display a screen 151 (FIG. 19) on the monitor 61 for displaying the present values of the calibration posture (the angle target values) that has been called up (step S206), prompting the operator to determine whether or not the posture information that has been called up, i.e., the posture number that has been input, is correct (whether "OK" or "NG") is input (step S207), and determines which one of "OK" and "NG" is input (step S208). The inputting of whether or not the input posture information or the input posture number is not wrong is determined by, for example, turning the screen switching/determining switch 75 to select one of the alternatives "OK"/"NG" displayed on the confirming screen displayed on the monitor 61, and depressing the screen switching/determining switch 75. Alternatively, "OK" may be input by turning the screen switching/determining switch 75 to select an item 151*a* for a tick (a check mark) on the screen 151 (FIG. 18), and depressing the screen switching/determining switch 75, or "NG" may be input by depressing the previous screen returning switch 79. If it is determined in step S208 that "NG" is input, then the processing of steps S204 through S207 is repeated until "OK" is input.

If it is determined in step S208 that "OK" is input, then the calibration posture storing section 60*a* controls the monitor controller 62 to display a screen on the monitor 61 (not depicted) for prompting the operator to operate the MC standby switch 76 and the MC on/off switch 77, letting the operator operate the MC standby switch 76 and the MC on/off switch 77 (step S209), and determines whether the MC standby switch 76 and the MC on/off switch 77 are operated or not (step S210). If the determined result from step S210 is NO, then the processing of step 209 is repeated.

If the determined result from step S210 is YES, i.e., if the MC standby switch 76 and the MC on/off switch 77 are operated, then since the machine control in the hydraulic excavator 1 is enabled, the calibration posture storing section 60*a* controls the monitor controller 62 to display, in a screen 152 (FIG. 20) on the monitor 61, information indicating to the operator that the machine control according to the calibration posture controlling process is being carried out (e.g., character information 152*a* representing "OPERATING IN CALIBRATION POSTURE CONTROLLING PROCESS") (step S211).

Then, the calibration posture storing section 60*a* determines whether the driven members (the boom 31, the arm 33, and the bucket 35) are being operated or not (whether the control lever devices 72, 73 and 74 are being operated or not, from the detected results from the pilot pressure primary pressure sensors 118 through 123. If the determined result is NO, then the processing of step S212 is repeated until the determined result from step S212 becomes YES.

If the determined result from step S212 is YES, then the calibration posture storing section 60*a* calculates present values of the boom angle, the arm angle, and the bucket angle from the detected result from the boom angle sensor 63, the arm angle sensor 65, and the bucket cylinder stroke sensor 67 (step S213), and determines whether the present values of the boom angle, the arm angle, and the bucket angle respectively with respect to the boom 31, the arm 33, and the bucket 35 are equal to the angle target values (the posture information) corresponding to the calibration posture called up in steps S204 through S207 or not (step S214*a*, S214*b*, S214*c*).

If the determined result from step S214*a* is YES, then the calibration posture storing section 60*a* operates the solenoid-operated proportional valves 107 through 110 to interrupt the supply of oil under pressure to the bucket cylinder 36 through the control valve 102 (step S215*a*). If the determined result from step S214*a* is NO or if the processing of step S215*a* is finished, then control goes to the processing of step S216.

Similarly, if the determined result from step S214*b* is YES, then the calibration posture storing section 60*a* operates the solenoid-operated proportional valves 105, 106 to interrupt the supply of oil under pressure to the boom cylinder 32 through the control valve 101 (step S215*b*). If the determined result from step S214*b* is NO or if the processing of step S215*b* is finished, then control goes to the processing of step S216.

Furthermore, if the determined result from step S214*c* is YES, then the calibration posture storing section 60*a* operates the solenoid-operated proportional valves 103, 104 to interrupt the supply of oil under pressure to the arm cylinder 34 through the control valve 100 (step S215*c*). If the determined result from step S214*c* is NO or if the processing of step S215*c* is finished, then control goes to the processing of step S216.

In step S216, the calibration posture storing section 60*a* determines whether the present values of the boom angle, the arm angle, and the bucket angle respectively with respect to all of the boom 31, the arm 33, and the bucket 35 are equal to the angle target values or not (step S216). If the determined result is NO, then the processing of steps S211 through S215*a*, S211 through S215*b*, S211 through S215*c* is repeated. If the determined result from step S216 is YES, then the calibration posture storing section 60*a* controls the monitor controller 62 to display, in a screen 153 (FIG. 21) on the monitor 61, information indicating to the operator that the calibration posture controlling process is completed and the front work implement 30 has taken a calibration posture (e.g., character information 153*a* representing "CALIBRATION POSTURE COMPLETE") (step S217). Then, the processing sequence is ended.

According to the present embodiment, there has been described an arrangement in which the hydraulic actuators 32, 34 and 36 for actuating the driven members 31, 33 and 35 are inactivated if the posture information (the boom angle, the arm angle, and the bucket angle) of the driven members 31, 33 and 35 becomes equal to the angle target values. However, the construction machine may additionally have the following arrangements:

The calibration posture controlling process may be carried out such that the hydraulic actuators 32, 34 and 36 may actuate the driven members 31, 33 and 35 in directions to reduce the differences between the present values of the posture information and the angle target values, and may not actuate them in directions to increase the differences. With this arrangement, the calibration posture controlling process may be carried out to inactivate the hydraulic actuators 32, 34 and 36 if the operational speed of the hydraulic actuators 32, 34 and 36 decreases as the differences between the posture information and the angle target values are reduced, until the differences become zero, i.e., the present values of the posture information become equal to the angle target values.

According to the present embodiment, moreover, there is an arrangement with respect to the boom cylinder 32 which includes only the solenoid-operated proportional valve (the boom lowering speed reducing valve) 105 for reducing the pilot pressure from the control lever device 72 and applying the reduced pilot pressure to the hydraulic actuating member 101*a*, and no solenoid-operated proportional valve (boom lowering speed reducing valve) for reducing the pilot pressure guided from the control lever device 72 to the hydraulic actuating member 101*b*, in which the calibration posture controlling process is enabled only during boom lowering operation. However, the present invention is not limited to such details. There may be, for example, an arrangement including a solenoid-operated proportional valve (a boom lowering speed reducing valve) for reducing the pilot pressure from the control lever device 72 and applying the reduced pilot pressure to the hydraulic actuating member 101*b* based on an operation signal from the computer-aided construction controller 60, in which the calibration posture controlling process is enabled with respect to all directions in which the driven members 31, 33 and 35 are actuated.

An example of a calibration process of the front work implement 30 according to the present embodiment will be described below.

A calibration process of a construction machine which performs machine control, such as the hydraulic excavator 1 according to the present embodiment, is carried out by, for example, eliminating the difference between the position of the claw tip of the bucket 35 in a local coordinate system calculated from the detected values from the posture sensors 63, 65 and 67 disposed on the front work implement 30 and the machine body (the upper swing structure 20 and the lower track structure 10) and the position of the claw tip measured from outside the hydraulic excavator 1. Specifically, a plurality of predetermined postures (calibration postures) are obtained based on detected values from the posture sensors 63, 65 and 67, the differences between the positions of the claw tip of the bucket 35 at this time and the positions of the claw tip measured from outside the hydraulic excavator 1 are calculated, and the detected values from the posture sensors 63, 65 and 67 are corrected to eliminate those differences, thereby assuring the accuracy of the positions of the claw tip based on the detected values from the posture sensors 63, 65 and 67 in the machine control.

The calibration process illustrated below is by way of example only, and the configuration and number of calibration postures shall be varied appropriately depending on the accuracy of construction required.

Figure 22:
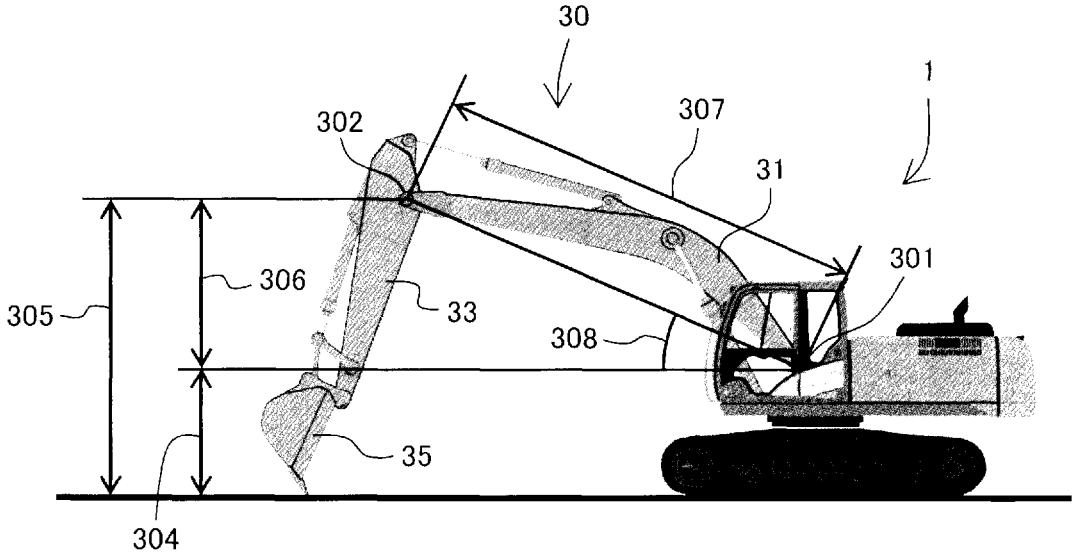
FIG. 22 is a side elevational view explaining positions where markers used as references to be measured from outside are attached to the hydraulic excavator.
Figure 23:
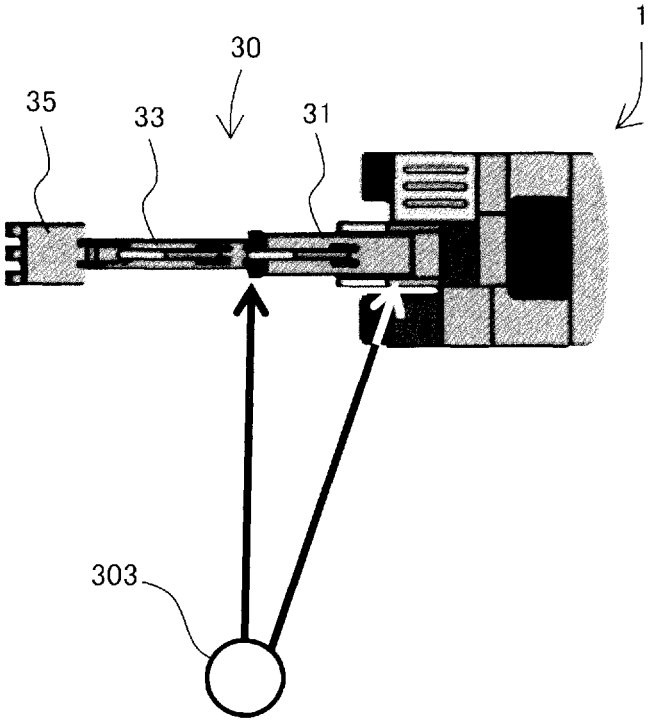
FIG. 23 is a plan view illustrating the manner in which the markers are measured from outside.

FIG. 22 is a side elevational view explaining positions where markers used as references to be measured from outside are attached to the hydraulic excavator. FIG. 23 is a plan view illustrating the manner in which the markers are measured from outside. FIGS. 24 through 27 are views illustrating examples of calibration postures. For the sake of brevity, a calibration process with respect to the posture sensor for the boom 31 (the boom angle sensor 63) among the plural posture sensors will be described by way of illustrative example below.

(Procedure 1) In the calibration process, a marker 301 is attached to the center of the boom pin 37 of the boom 31 and a marker 302 is attached to the center of the arm pin 38. At this time, the marker 301 and the marker 302 are attached to the same side surface of the front work implement 30 (see FIG. 22).

(Procedure 2) Next, a total station 303 is installed at a position where the markers 301 and 302 on the side surface of the front work implement 30 can be visually recognized (see FIG. 23).

Figure 24:
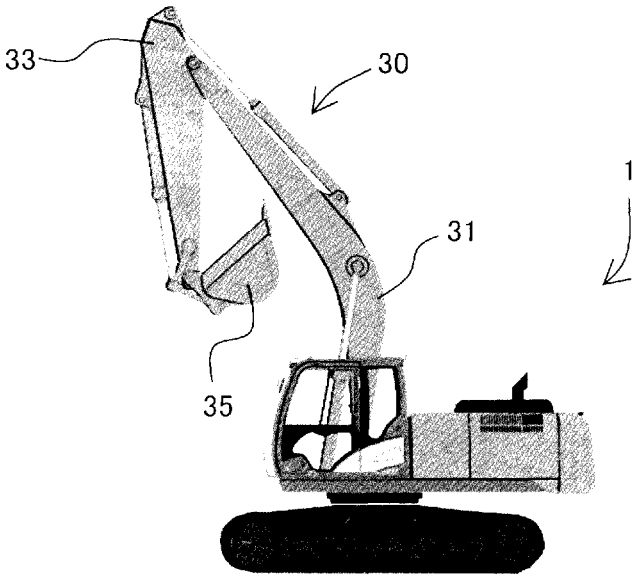
FIG. 24 is a view illustrating an example of a calibration posture.

(Procedure 3) Next, the boom 31, the arm 33, and the bucket 35 are operated based on the angles (the boom angle, the arm angle, and the bucket angle) that are based on the detected values from the boom angle sensor 63, the arm angle sensor 65, the bucket cylinder stroke sensor 67 that are installed on the front work implement 30, obtaining a calibration posture illustrated by way of example in FIG. 24. The calibration posture illustrated in FIG. 24 represents a state in which the arm is fully pulled, the bucket is fully pulled, and the boom is fully lifted. At this time, the front work implement 30 can easily be brought into the calibration posture by performing the calibration posture controlling process according to the present invention.

(Procedure 4) Next, the height 304 of the marker 301 and the height 305 of the marker 302 are measured using the total station 303.

(Procedure 5) Next, the height 306 between the height 304 of the marker 301 and the height 305 of the marker 302 is calculated from measured values of the height 304 of the marker 301 and the height 305 of the marker 302 by the total station 303.

(Procedure 6) Furthermore, a boom angle 308 is calculated from the length 307 of the boom 31 stored in the computer-aided construction controller 60, the height 304 of the marker 301, and the height 305 of the marker 302.

(Procedure 7) Next, the difference between the detected value from the boom angle sensor 63 and the boom angle 308 calculated in Procedure 3 is calculated as a calibration angle.

Figure 25:
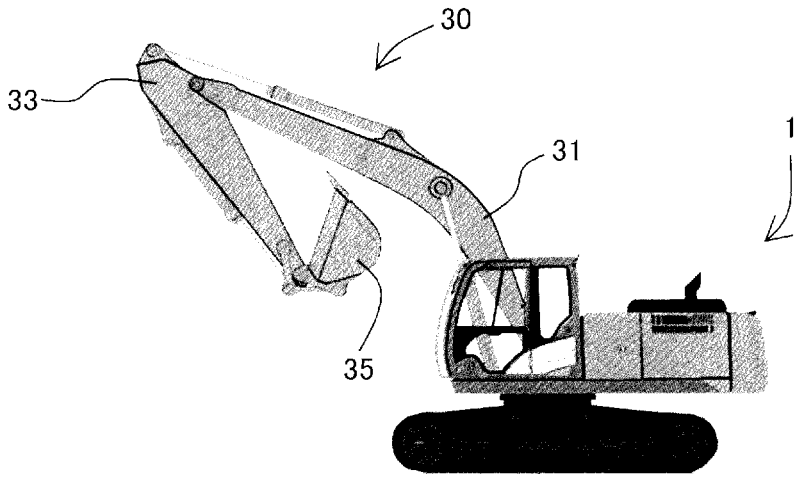
FIG. 25 is a view illustrating an example of a calibration posture.

(Procedure 8) Procedures 3 through 7 are carried out on a plurality of other predetermined calibration postures. The other predetermined calibration postures include the following postures, for example:

A calibration posture in which the arm is fully pulled, the bucket is fully pulled, and the boom angle: −40 degrees±three degrees (see FIG. 25).

Figure 26:
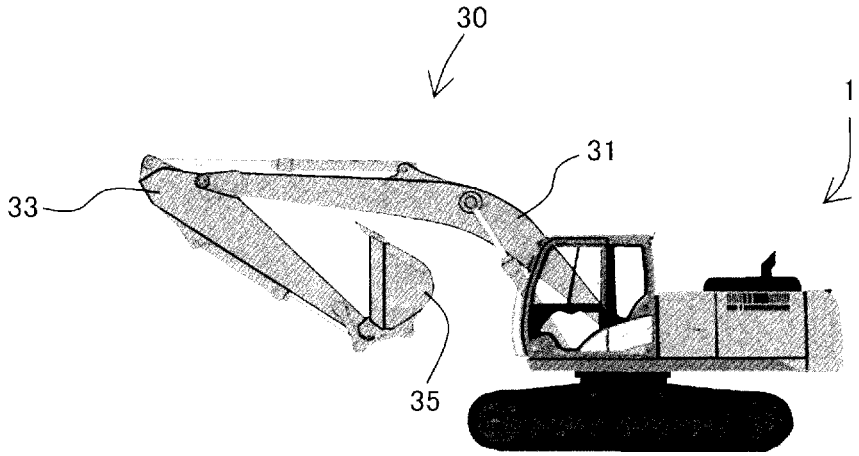
FIG. 26 is a view illustrating an example of a calibration posture.

A calibration posture in which the arm is fully pulled, the bucket is fully pulled, and the boom angle: −20 degrees±three degrees (see FIG. 26).

Figure 27:
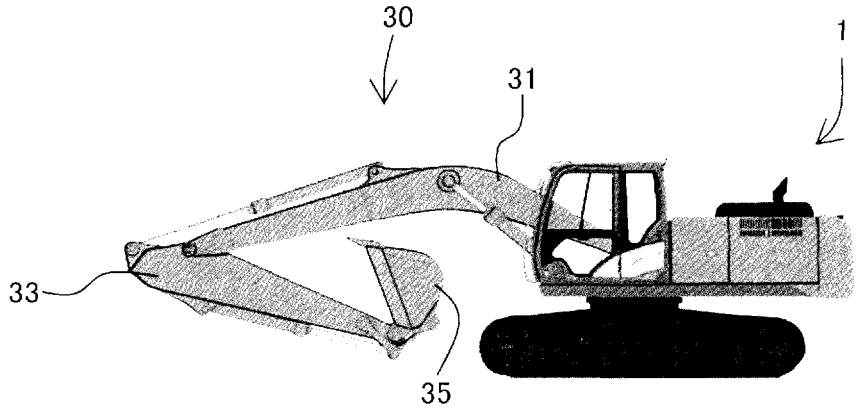
FIG. 27 is a view illustrating an example of a calibration posture.

A calibration posture in which the arm is fully pulled, the bucket is fully pulled, and the boom is lowered as much as possible (see FIG. 27).

(Procedure 9) If the difference between a minimum value and a maximum value of the calibration angle calculated in each of the calibration postures (FIGS. 25 through 27) falls in an allowable range, then the result of the calibration process is deemed acceptable. The allowable range may be within 0.4 degrees, for example. If the calibration angle falls outside the allowable range, then a maximally deviating value of the calibration angle is removed and a remeasurement is made. If the calibration angle does not fall in the allowable range even after the remeasurement has been made, then the length 307 of the boom 31 is remeasured, and the calibration process is carried out again.

(Procedure 10) The calibration process is carried out on the driven members other than the boom 31 (the arm 33 and the bucket 35) in the same procedures as with the boom 31.

Next, features of the above embodiment will be described below.

(1) In the above embodiment, the construction machine (e.g., the hydraulic excavator 1) includes the multi-joint front work implement 30 that is made up of a plurality of driven members (e.g., the boom 31, the arm 33, and the bucket 35) that are joined together, the plurality of hydraulic actuators (e.g., the boom cylinder 32, the arm cylinder 34, and the bucket cylinder 36) that actuate the plurality of driven members based on operation signals, the operation devices (e.g., the control lever devices 72, 73 and 74) that output the operation signals to those hydraulic actuators which are desired by the operators, among the plurality of hydraulic actuators, the plurality of posture sensors (e.g., the boom angle sensor 63, the arm angle sensor 65, the bucket cylinder stroke sensor 67) that detect posture information about postures of the plurality of driven members, and the controller (e.g., the computer-aided construction controller 60) that carries out machine control for operating the front work implement based on detected results from the posture sensors and predetermined conditions, in which the controller has the calibration posture storing section **60*a* that stores at least one predetermined calibration posture of the front work implement for calibrating the posture sensors, and the calibration posture controlling section 60*b*** that carries out the machine control to inactivate the hydraulic actuators if detection target values of the posture sensors in the calibration posture and the detected results from the posture sensors are equal to each other.

According to the prior art, the operator operates the boom, the arm, and the bucket while viewing the display on the monitor thereby to perform an adjusting process for causing the front work implement to take a prescribed posture (a calibration posture). However, for achieving a calibration posture, it is necessary to make strict adjustments with respect to the angles of the various components of the front work implement. Since the operator achieves a prescribed posture by repeatedly operating the actuators, it takes time to adjust the front work implement to the prescribed posture, contributing to an increase in the number of man hours.

According to the present embodiment, in contrast, forces and speeds can be increased appropriately only in a process required by the operator while at the same time reducing the burden on the operator, with the result that wasteful increases in forces and process speeds during the process can be restrained.

(2) According to the above embodiment, furthermore, in the construction machine referred to in (1), the calibration posture storing section stores a plurality of predetermined calibration postures, and the calibration posture controlling section selectively sets one of the calibration postures stored in the calibration posture storing section.

(3) According to the above embodiment, furthermore, in the construction machine referred to in (1), the plurality of posture sensors are at least one type of angle sensors disposed on the joints of the driven members of the front work implement, stroke sensors disposed on the hydraulic actuators, and tilt sensors disposed on the driven members. <Addendum>

In the above embodiment, the general hydraulic excavator where the hydraulic pumps are actuated by the prime mover such as the engine or the like has been described by way of illustrative example. However, the present invention is also applicable to hybrid hydraulic excavators where a hydraulic pump is actuated by an engine and an electric motor and electric hydraulic excavators where a hydraulic pump is actuated only by an electric motor.

The present invention is not limited to the above embodiment, but covers various modifications and combinations within a range not deviating from the scope of the invention. Moreover, the present invention is not limited to arrangements including all the structures described in the above embodiment, but includes arrangements in which some of the structures are deleted. The above structures, functions, and so on may partly or wholly be realized by designing them with integrated circuits, for example. The above structures, functions, and so on may be software-implemented by programs for realizing the functions, interpreted and executed by a processor.

DESCRIPTION OF REFERENCE CHARACTERS

1: Hydraulic excavator
10: Lower track structure
11*a*, 11*b*: Crawler
12*a*, 12*b*: Crawler frame
13*a*, 13*b*: Track hydraulic motor
20: Upper swing structure
21: Swing frame
22: Engine
30: Front work implement
31: Boom
32: Boom cylinder
33: Arm
34: Arm cylinder
35: Bucket
36: Bucket cylinder
37: Boom pin
38: Arm pin
39: Bucket pin
40: Hydraulic circuit system
41: Main hydraulic pump
42: Pilot hydraulic pump
60: Computer-aided construction controller
60*a*: Calibration posture storing section
60*b*: Calibration posture controlling section
60*c*: Machine control controlling section
61: Monitor (display device)
62: Monitor controller
63: Boom angle sensor
64: Boom angle sensor lever
65: Arm angle sensor
66: Arm angle sensor lever
67: Bucket cylinder stroke sensor
68: Machine body tilt sensor
70: Operation seat
71: Gate lock lever
72-74: Control lever device
72*a*-74*a*: Control lever
75: Screen switching/determining switch
76: Standby switch
77: On/off switch
78: Ten-key pad
79: Switch
80: Switch panel
90, 91: Track lever
90*a*, 91*a*: Track pedal
100-102: Control valve
100*a*, 100*b*, 101*a*, 101*b*, 102*a*, 102*b*: Pressure bearing members ((hydraulic actuating members) 103-110: Solenoid-operated proportional valve
111-113: Shuttle valve
118-123: Primary pressure sensor
124-129: Secondary pressure sensor
130: MC solenoid-operated on/off valve
131: MC hydraulic shut-off valve
137: Shut-off valve outlet pressure sensor
138: Gate lock valve
140: Menu screen
141: Posture input screen
142: Posture number indicating screen
143: Posture target value input screen
144: Screen
145: Calibration posture deleting screen
146: Screen
150: Posture number indicating screen
151-153: Screen
170: Operation room
301, 302: Marker
303: Total station

The invention claimed is:

1. A construction machine comprising:

a multi-joint front work implement that is made up of a plurality of driven members that are joined together;

a plurality of hydraulic actuators that actuate the corresponding plurality of driven members, each based on an operation signal;

an operation device that outputs the operation signal to one of the hydraulic actuators, the one hydraulic actuator being desired by an operator, among the plurality of hydraulic actuators;

a plurality of posture sensors that detect posture information about postures of the plurality of the driven members; and a controller that carries out machine control for automatically operating at least one of plurality of hydraulic actuators such that the front work implement operates, based on detected results from the posture sensors and predetermined conditions, wherein the controller:

stores at least one predetermined calibration posture of the front work implement for calibrating the posture sensors;

carries out the machine control such that the at least one of the plurality of hydraulic actuators may actuate only in a direction which reduces the differences between a detection target value of the posture sensor in the calibration posture and a detection value of the posture sensor and inactivate at least one other hydraulic actuator if differences between the detection target value of the posture sensor in the calibration posture and the detection value of the posture sensor decrease in a case where a calibration posture controlling mode is selected by the operator; and carries out the machine control to inactivate the at least one of the plurality of hydraulic actuators in a case where the detection target value of the posture sensor and the detection value of the posture sensor become equal to each other.

2. The construction machine according to claim 1, wherein the controller:

stores a plurality of predetermined calibration postures; and selectively sets one of the plurality of the stored calibration postures.

3. The construction machine according to claim 1, wherein the plurality of the posture sensors are at least any one type of an angle sensor disposed on a joint of the driven members, a stroke sensor disposed on the hydraulic actuators, and a tilt sensor disposed on the driven members of the front work implement.

* * * * *